US007556014B2

(12) United States Patent
Mason

(10) Patent No.: US 7,556,014 B2
(45) Date of Patent: Jul. 7, 2009

(54) RECIPROCATING MACHINES

(76) Inventor: David John Mason, 2 Upper Broomieknowe, Lasswade (GB) EH18 1LP ( * ) Notice: Subject to any disclaimer, the term of this patent is extended or adjusted under 35 U.S.C. 154(b) by 70 days.

(21) Appl. No.: 11/791,047

(22) PCT Filed: Nov. 30, 2005

(86) PCT No.: PCT/GB2005/004593

§ 371 (c)(1),
(2), (4) Date: May 17, 2007

(87) PCT Pub. No.: WO2006/059100

PCT Pub. Date: Jun. 8, 2006

(65) Prior Publication Data

US 2008/0115769 A1 May 22, 2008

(30) Foreign Application Priority Data

Nov. 30, 2004 (GB) ..... 0426228.3

(51) Int. Cl.
*F02B 75/32* (2006.01)

(52) U.S. Cl. ..... 123/197.4; 123/197.1

(58) Field of Classification Search ..... 123/197.1, 123/197.4

See application file for complete search history.

(56) References Cited

U.S. PATENT DOCUMENTS

| | | | | |
|---|---|---|---|---|
| 460,642 A | | 10/1891 | Kitson et al. | |
| 1,326,129 A | * | 12/1919 | Chadbourne | 123/78 F |
| 1,964,096 A | * | 6/1934 | Tucker | 123/78 F |
| 4,044,629 A | * | 8/1977 | Clarke | 123/78 B |
| 4,966,043 A | * | 10/1990 | Frey | 123/197.4 |
| RE36,951 E | | 11/2000 | Cooper et al. | |
| 6,145,394 A | | 11/2000 | Sferco | |
| 2004/0055557 A1 | * | 3/2004 | Ozdamar | 123/197.4 |
| 2004/0159291 A1 | | 8/2004 | Schmied | |

FOREIGN PATENT DOCUMENTS

EP 570627 A1 * 11/1993

(Continued)

OTHER PUBLICATIONS

WO 86/07115 International Application published under the PCT treaty (PCT/AU86/00148), dated Dec. 4, 1986.*

(Continued)

*Primary Examiner*—Noah Kamen
(74) *Attorney, Agent, or Firm*—Drinker, Biddle & Reath, LLP

(57) ABSTRACT

A four-stoke reciprocating internal combustion engine includes the capability to change the distance between the crankshaft axis and the big end of the connecting rod and hence the maximum cylinder displacement within a combustion cycle. This provides for a given inducted volume of gases to be expanded over a greater volume. An exhaust gas aperture is uncovered by the piston towards the end of the expansion stroke. The piston and crankcase space serves as a pre-compression space for supercharging air to be inducted into the cylinder via ducts. A unitary valve device sliding axially co-operates with intake and exhaust apertures of the combustion cylinder. The unitary device extends at times into a recess in the head of the piston. A diffuse ignition source is provided. A fuel pump is operated by action of the piston.

24 Claims, 14 Drawing Sheets

FOREIGN PATENT DOCUMENTS

| | | | | |
|---|---|---|---|---|
| FR | 801164 | | | 10/1936 |
| GB | 25470 | | | 11/1910 |
| GB | 2266753 | A | | 11/1993 |
| JP | 08135452 | A | * | 5/1996 |
| WO | WO 00/58612 | | | 10/2000 |

OTHER PUBLICATIONS

Partial European Search Report dated Oct. 17, 2008 for European Patent No. 08 01 4598.

* cited by examiner

RECIPROCATING MACHINES

The present invention relates to improvements to reciprocating machines such as pumps, compressors, gas or fluid driven motors and internal combustion engines.

The basic design of the reciprocating internal combustion engine has remained relatively unchanged for over a century. Typically, a connecting rod connects a piston, which moves linearly in a cylinder, to the offset throw of a crankshaft arranged at 90° to the travel of the piston. This arrangement translates the linear movement of the piston into a rotational movement of the crankshaft via the interaction of the connecting rod and a sliding 'big end' bearing mounted between the connecting rod and the offset throw of the crankshaft. Thus, each stroke of the piston is translated into a semi-circular rotation of the crankshaft and by geometrical symmetry the crankshaft then completes its full cycle and reciprocates an equal but opposite stroke to the piston. The stroking movement of the piston within the cylinder therefore occurs over a fixed distance in both directions of travel during each complete cycle of the crankshaft. Energy to induce this movement is provided by the introduction and subsequent compression and combustion of mixed gases within the cylinder. The resulting expansion under combustion causes a rise in pressure which forces the piston linearly towards the crankshaft end of the cylinder. This movement is then reciprocated in the opposite direction by the interaction of the crankshaft and connecting rod and stored energy in the crankshaft arrangement.

Over the years, improvements in the efficiency of the internal combustion engine have been achieved by several means. Such means have included more accurate control of the timing, the atomisation and amount of fuel being input to the cylinder by means of pressurised fuel injection, electronic mapping of the engine's operating parameters to optimise power/efficiency and achieving more complete combustion (thereby reducing toxic emissions), increasing the amount of combustion air being induced by multi-valving, by forced induction (turbocharging or supercharging), or by various combinations of these.

Nevertheless, the depressingly inflexible laws of thermodynamics govern the performance of all heat engines. The CARNOT cycle describes these limits for ideal gases operating within a closed chamber. On a more practical level, the interaction between pressure and volume resulting in work done on and by a gas within an internal combustion heat engine are described by the OTTO (spark ignition) and DIESEL (compression ignition) cycles.

These pressure/volume diagrams have been approximated and combined within FIG. 15 which shows the four stroke cycle of both spark and compression ignition internal combustion engines.

The area under each curve, calculated by changes in pressure and volume (displacement of the piston) within the closed cylinder, represents a measure of the work done. Causing the curves to move up the diagram by increasing pressure during the compression stroke (a higher compression ratio) will indeed cause a higher pressure curve after combustion. This has been shown to improve thermal efficiency and hence work output. However, since it is the area between the power and compression curves which gives a measure of work done during the cycles, an increase in compression ratio will also require a higher work input, and in any case is limited by pre-ignition problems due to the detonation properties of the hydrocarbon based fuels.

It is interesting to note that—although not clear from this diagram—the DIESEL compression ignition cycle approaches closer to the efficiency limits of the ideal CARNOT cycle than does the OTTO spark ignition cycle. This is partly due, as explained above, to the inherently higher compression ratio allowable (and in fact necessary) to compression detonate the less volatile fuel oil within Diesel cycle engines. It is also due to the less abrupt 'burn period' which maintains a higher mean pressure for more of the power stroke.

Due to these factors, Diesel cycle engines subsequently deliver a higher torque—albeit over a lower and more restricted speed range—than Otto cycle engines. This is one of the reasons which make Diesel engines ideal for marine propulsion applications where high torque at low engine speed is desirable to initiate propulsion and during manoeuvring. The disadvantage of this limited speed range is more pronounced when Diesel cycle engines are used in road vehicle applications, which demand a large speed range, and the problem is overcome by introducing additional gear ratios. Even so the Diesel cycle in its current form is not a universally ideal internal combustion engine.

The main problem in achieving an increase in expansion within traditional reciprocating engines is just that—they are indeed reciprocating. The geometry between crank, connecting rod and piston dictates that their swept volume during the induction stroke is equal to that during the expansion or power stroke.

A further inherent problem with traditional engines, which is often overlooked, is that the residual combustion gases from the previous cycle remain in the un-swept volume of the combustion chamber to contaminate the next charge of air and fuel. This degrades the speed and efficiency of the combustion process in several ways, and leads to secondary exhaust products which are major contributors to toxic pollution.

In order to improve specific power outputs, it has been long recognised that supercharging of the incoming combustion air provides a major improvement to output—especially in the case of diesel engines where a lack of rotational speed can be compensated for by increased torque as mentioned. Supercharging is achieved by various methods, but each results in an increase in complexity.

Likewise, highly pressurised fuel injection systems which have been deployed to improve combustion efficiency also result in a more complex fuel supply and distribution system.

Mindful of the above limitations and the general desire to achieve ever greater efficiency of operation and a reduction of toxic waste products, the present inventor has devised various improvements applicable in internal combustion engines and other reciprocating machines, which are now presented as aspects of the present invention.

In accordance with a first aspect of the invention, there is provided apparatus for changing a maximum cylinder displacement in an internal combustion engine having a combustion cycle of at least four strokes, the apparatus comprising:

a crankshaft rotatable about a crankshaft axis, a connecting rod in engagement towards a first end with a throw of the crankshaft and configured to couple towards a second end to a piston in a cylinder of the internal combustion engine, wherein the apparatus is configured to change, when in use, a distance between the crankshaft axis and the second end of the connecting rod from a point during a revolution of the crankshaft to the same point during a subsequent revolution of the crankshaft.

The capability to change the distance between the crankshaft axis and the second end of the connecting rod and hence the maximum cylinder displacement within a combustion cycle can have the advantage of providing for more efficient operation of an internal combustion engine. More specifically, this provides for a given inducted volume of gases to be expanded over a greater volume. This can have significant thermodynamic and combustion chemistry benefits and can lead to a significantly more thermally efficient and hence economical engine with cleaner toxic omissions. In addition, a mechanical advantage can be provided because the moment arm of the connecting rod and crankshaft arrangement can be greater during the power stroke when it is most beneficial. This increase in expansion of combusted gases coupled with an increase in piston movement and torque applied to the crankshaft can increase the amount of power extracted from the induced gas charge. In addition, the arrangement permits the induced gas charge to execute a more complete 'burn' during the extended combustion stroke.

In relation to conventional four-stroke internal combustion operation the minimum cylinder displacement may be caused to occur during the first revolution of the crankshaft during the transition from the suction stroke to the compression stroke. The maximum cylinder displacement during the second revolution of the crankshaft may be caused to occur during the transition from the expansion stroke to the exhaust stroke.

More specifically, the distance between the crankshaft axis and the second end of the connecting rod may be greater at a point (e.g. the transition from the suction stroke to the compression stroke) during the first revolution of the crankshaft than at the same point (e.g. the transition from the expansion stroke to the exhaust stroke) during the second revolution of the crankshaft. Thus, the maximum cylinder displacement may be greater during the third and fourth strokes than during the first and second strokes within a four stroke combustion cycle. Having a piston travel a shorter distance during the pre-combustion first and second strokes thus inducing a prescribed quantity of combustion gases then expanding the combusted gases over a greater piston travel during the energy producing third stroke can provide for more energy efficient operation.

In addition, having a changing length of piston travel from one part of the combustion cycle to the next can provide for improved operation and/or variation as regards, for example, exhaust gas scavenging and induction of combustion gases.

Alternatively or in addition, the apparatus may be configured to change from a point during a revolution of the crankshaft to the same point during a subsequent revolution of the crankshaft a location on at least one of the connecting rod and the throw of the crankshaft at which the first end of the connecting rod and the throw of the crankshaft engage with each other.

More specifically, the apparatus may be configured to change from a point during a revolution of the crankshaft to the same point during a subsequent revolution of the crankshaft a location on the connecting rod at which the first end of the connecting rod and the throw of the crankshaft engage with each other.

Alternatively or in addition, the change in the distance between the crankshaft axis and the second end of the connecting rod from a point during a revolution of the crankshaft to the same point during a subsequent revolution of the crankshaft may be progressive.

More specifically, the apparatus may comprise an eccentric coupling between the crankshaft and the connecting rod, the eccentric coupling being operative to provide the progressive change in distance.

According to a first form of the invention, the apparatus may comprise an epicyclic gear means for coupling movement of the first end of the connecting rod to the throw of the crankshaft.

More specifically, the epicyclic gear means may be provided on the throw of the crankshaft.

Alternatively or in addition, the connecting rod may define an aperture the geometric centre of which is offset from a centre of the first end of the connecting rod and with which the throw of the crankshaft rotatably engages.

More specifically, the throw of the crankshaft may travel around an internal circumference of the aperture.

More specifically, the aperture and the throw of the crankshaft may comprise respective teethed portions which engage with each other during travel of the throw around the internal circumference.

Alternatively or in addition, the connecting rod may comprise a connecting rod gear, which defines the aperture and which is rotatably located on the connecting rod such that, in use, it moves generally to and fro on the connecting rod as the throw of the crankshaft travels around the circumference of the aperture.

More specifically, the first end of the connecting rod may define a connecting rod gear receiving aperture in which the connecting rod gear is rotatably located.

Alternatively or in addition, the epicyclic gear means may comprise a fixed gear fixedly located on the throw and a plurality of rotatable gears spaced apart around the fixed gear, and, in use, the aperture defined by the connecting rod cooperates with the rotatable gears, which in turn cooperate with the fixed gear, whereby movement of the connecting rod is coupled to movement of the crankshaft.

More specifically, the plurality of rotatable gears may comprise three rotatable gears spaced apart equally around the fixed gear.

Alternatively or in addition, the fixed gear and the plurality of rotatable gears may comprise toothed portions for engagement of the fixed gear with the rotatable gears.

Alternatively or in addition, the epicyclic gear means may be configured such that the throw of the crankshaft describes a substantially complete revolution within the circumference of the aperture each combustion cycle.

According to a second form of the invention, the first end of the connecting rod may comprise a connecting rod gear and the throw of the crankshaft may comprise a throw gear, the connecting rod gear and the throw gear being of relative dimensions such that, in use, they cooperate to provide progressively for a change in distance between the crankshaft axis and the second end of the connecting rod from a point during a revolution of the crankshaft to the same point during a subsequent revolution of the crankshaft.

More specifically, the connecting rod gear may be of greater diameter than the throw gear such that as the throw gear travels on a circumference of the connecting rod gear there is a progressive variation in the extent to which the throw gear (and hence the throw) is offset laterally of a centre line of the first end of the connecting rod during a combustion cycle.

During a four stroke combustion cycle the apparatus may be operative such that the throw gear lies on the centre line of the first end of the connecting rod at two points. For example, when the piston is at its minimum lowest location during the first half of the cycle and a full half cycle later during the second half of the cycle when the piston is at its maximum lowest location.

More specifically, the connecting rod gear may define an aperture having a geometric centre substantially concentric with the first end of the connecting rod and the throw gear may be operative to travel on the internal circumference of the aperture.

More specifically, the throw gear may be mounted concentrically on a crank pin of the crankshaft and the connecting rod gear may be mounted eccentrically on the crank pin. The connecting rod gear may be comprised in the connecting rod in the sense that they mechanically cooperate, e.g. by the connecting rod gear being received in a connecting rod gear receiving aperture, whereby movement of the connecting rod is imparted to the connecting rod gear.

The mounting of the throw gear and the connecting rod gear on the crank pin in this way can hold the throw gear in its proper location in relation to the connecting rod gear to provide for the requisite eccentric movement.

Alternatively or in addition, the connecting rod gear and the throw gear may comprise respective toothed portions which in use engage with each other.

Alternatively or in addition, the connecting rod gear may be mounted on the first end of the connecting rod such that, in use, the connecting rod gear moves generally to and fro on the first end during a combustion cycle.

More specifically, the first end of the connecting rod may define a connecting rod gear receiving aperture in which the connecting rod gear is rotatably located.

Alternatively or in addition, the throw gear may be rotatably mounted on the throw of the crankshaft.

More specifically, the throw gear may be concentric with the crank pin.

According to a third form of the invention, the first end of the connecting rod may comprise a connecting rod gear and the crankshaft may comprise a crankshaft gear, the connecting rod gear and the crankshaft gear being located on the apparatus such that, in use, they cooperate to provide progressively for the change in distance between the crankshaft axis and the second end of the connecting rod from a point during a revolution of the crankshaft to the same point during a subsequent revolution of the crankshaft.

More specifically, the connecting rod gear may be mounted eccentrically on the connecting rod to thereby provide progressively for the change in distance.

More specifically, the crankshaft gear may be mounted concentrically with the crankshaft axis.

Alternatively or in addition, the connecting rod gear may be mounted on a bearing provided on the first end of the connecting rod.

Alternatively or in addition, the connecting rod gear may be of greater diameter than the crankshaft gear.

Alternatively or in addition, the crankshaft gear may be fixedly mounted on the crankshaft and the connecting rod gear may be rotatably mounted on the first end of the connecting rod.

Alternatively or in addition, the connecting rod gear and the crankshaft gear may comprise respective toothed portions which in use engage with each other.

The third form of the invention may be used alone or in conjunction with one or other of the first and second forms of the invention.

In the third form of the invention, the apparatus may further comprise control means configured to provide for cooperative movement of the connecting rod gear and the crankshaft gear that is independent of the cooperative movement of the connecting rod gear and the crankshaft gear associated with rotation of the crankshaft about the crankshaft axis.

The independent cooperative movement of the connecting rod gear and the crankshaft gear can allow for an advance or a delay of the particular point during a combustion cycle at which the piston is at its minimum and/or maximum lowest location during the combustion cycle. For example, in a four-stroke internal combustion operation the maximum cylinder displacement may be caused to occur slightly in advance of or after the transition from the suction stroke to the compression stroke.

Thus, the control means may be used to provide independent cooperative movement of the connecting rod gear and the crankshaft gear at any point during a combustion cycle.

An application of the independent movement achievable with the control means is to alter the timing of any one of the four strokes within a four stroke cycle or to provide different compression ratios or swept volumes within a combustion cycle. This can bring benefits in economy, e.g. where the engine is part-loaded, and longevity of the related moving parts of the engine.

More specifically, the control means may be controllable externally of an internal combustion engine incorporating the invention, e.g. by a user of the internal combustion engine.

More specifically, the control means may be controllable externally by electrical and/or mechanical means.

Alternatively or in addition, control means may comprise a crankshaft having a bore and a member passing through the bore, in which a first end of the member is coupled to external control means and a second, opposite end of the member is coupled to the crankshaft gear.

More specifically and in an internal combustion engine having two or more cylinders each having a crankshaft and connecting rod pair the control means may be configured to provide for independent control of each crankshaft and connecting rod pair.

More specifically, independent control of a first crankshaft and connecting rod pair may be coupled mechanically to the second crankshaft and connecting rod pair.

More specifically, the control means may comprise a second pair of crankshaft and connecting rod gears provided on an opposite of the side of the connecting rod to the first pair of crankshaft and connecting rod gears.

More specifically, opposing connecting rod gears of each crankshaft and connecting rod pair may be coupled to each other (e.g. via the connecting rod) and adjacent crankshaft gears of adjacent crankshaft and connecting rod pairs may be coupled to each other, whereby movement of a crankshaft gear of a first crankshaft and connecting rod pair is coupled to crankshaft gears of successive crankshaft and connecting rod pairs.

More specifically, adjacent crankshaft cog means of adjacent crankshaft and connecting rod pairs may be coupled to each other by means of a further member passing through a bore in a section of crankshaft between the adjacent crankshaft and connecting rod pairs.

In accordance with another aspect of the invention, there is provided apparatus for changing a maximum cylinder displacement in an internal combustion engine having a combustion cycle of at least four strokes, the apparatus comprising: a crankshaft rotatable about a crankshaft axis, a connecting rod in engagement towards a first end with a throw of the crankshaft and configured to couple towards a second end to a piston in a cylinder of the internal combustion engine, wherein the apparatus is configured to change, when in use, a distance traveled by the piston within the cylinder during the course of a combustion cycle.

In accordance with a second aspect of the invention, there is provided a method of changing a maximum cylinder displacement in an internal combustion engine, the method comprising:

engaging a throw of a crankshaft towards a first end of a connecting rod, the crankshaft being rotatable about a crankshaft axis, coupling a piston of an internal combustion engine towards a second end of the connecting rod, and configuring the crankshaft and connecting rod to change, when in use, a distance between the crankshaft axis and the second end of the connecting rod from a point during a revolution of the crankshaft to the same point during a subsequent revolution of the crankshaft.

Further embodiments of the second aspect of the present invention may comprise one or more features described above according to the first aspect of the present invention.

According to a third aspect of the present invention, there is provided an internal combustion engine having a combustion cycle of at least four strokes comprising an arrangement according to the first aspect of the present invention.

More specifically in a reciprocating four stroke internal combustion arrangement, the internal combustion engine may comprise an exhaust gas aperture provided in a cylinder of the internal combustion engine, the internal combustion engine being configured to close the exhaust gas aperture during at least a compression stroke of the cycle and to open the exhaust gas aperture towards the end of an expansion stroke of the cycle, and wherein the exhaust gas aperture is in the vicinity of the piston when the piston is situated in the cylinder towards the end of the expansion stroke.

More specifically, the internal combustion engine may be configured such that the exhaust gas aperture is opened and closed by movement of the piston in the cylinder during the course of the cycle.

More specifically, the exhaust gas aperture may be operative to open during a longer length of stroke of the piston and to remain closed during a shorter length of stroke of the piston during the cycle.

Alternatively or in addition, the internal combustion engine may further comprise an exhaust port located towards a top of the cylinder which is operable in accordance with conventional practice of an internal combustion engine.

Alternatively or in addition, the internal combustion engine may further comprise a substantially air-tight space defined by a part of the internal combustion engine, the space being in fluid communication with a piston moveably situated in a cylinder such that, in use, air within the space is compressed as the piston moves toward the open end of the cylinder, and at least one of the piston and the part of the internal combustion engine is configured to open an aperture to the space after compression of the air, the aperture being in fluid communication with an air intake to the cylinder, whereby compressed air is released from the space to the cylinder.

More specifically, at least one of the piston and the part of the internal combustion engine may be configured to open the aperture by movement of the piston in the cylinder during the course of a cycle.

More specifically, the piston may define a conduit which is open at an end to the space and is in fluid communication at another end with the aperture during part of the movement of the piston in the cylinder.

Alternatively or in addition, at least one of the piston and the part of the internal combustion engine may be configured to open a further aperture to the space before compression of the air, whereby air (e.g. atmospheric air) is admitted to the space prior to compression.

More specifically, at least one of the piston and the part of the internal combustion engine may be configured to open the further aperture by movement of the piston in the cylinder.

More specifically, the piston may define a further conduit which is open at an end to the space and is in fluid communication at another end with the further aperture during part of the movement of the piston in the cylinder.

Alternatively or in addition, the space defined by the part of the internal combustion engine may comprise a crankcase, e.g. a crankcase of a conventional internal combustion engine.

More specifically, the internal combustion engine may further comprise a dry sump.

Alternatively or in addition, the internal combustion engine may further comprise a trap for trapping oil vapour contained within the air compressed within the crankcase.

More specifically, the trap may be located between the aperture and the air intake to the cylinder.

Alternatively or in addition, the internal combustion engine may comprise a plurality of cylinders each cylinder having a substantially air-tight space associated with it and an aperture for releasing compressed air to an air intake of the cylinder.

Alternatively or in addition, fluid communication between the aperture and the air intake may be by means of an air intake conduit.

More specifically, where the air intake to the cylinder is a combustion air intake, at least one of the piston and the part of the internal combustion engine may be configured to open the aperture at about the transition between the suction and compression strokes.

More specifically, where the internal combustion engine comprises a further aperture, at least one of the piston and the part of the internal combustion engine may be configured to open the further aperture at about the transition between the compression and expansion strokes.

Alternatively or in addition, the internal combustion engine may further comprise a unitary device comprising a fluid intake valve and an fluid outlet valve, the unitary valve being operable during an operating cycle of the internal combustion engine to move in relation to a cylinder of the internal combustion engine to open a fluid intake aperture to the cylinder and to open a fluid outlet aperture to the cylinder.

More specifically, the unitary device may be operable to move to a first position at which neither the fluid intake aperture nor the fluid outlet aperture is open, to a second position at which the fluid intake aperture is open and the fluid outlet aperture is closed and to a third position at which the fluid intake aperture is closed and the fluid outlet aperture is open.

More specifically, the unitary device may be operable to move from one of the three positions to another by substantially linear movement in relation to the cylinder.

Alternatively or in addition, the unitary device may be operable to move substantially in a direction of a longitudinal axis of the bore of the cylinder.

Alternatively or in addition, the unitary device may define at least one conduit for each of fluid intake and fluid expulsion, each conduit being brought into fluid communication with the cylinder during the course of a cycle.

Alternatively or in addition, the cylinder and the unitary device may be configured for movement of at least part of the unitary device into the cylinder bore during the cycle.

More specifically, the unitary device may be moveable to a first position in the cylinder bore at which the fluid intake aperture is opened.

More specifically, the unitary device may be moveable to a second position in the cylinder bore at which the fluid outlet aperture is opened.

More specifically, the unitary device may be operable to reach further into the bore at the second position than at the first position.

Alternatively or in addition, the piston and unitary device may be configured such that part of one is received in the other during the course of the cycle.

More specifically, the piston may define a recess configured to receive at least a part of the unitary device.

More specifically, the unitary device and piston may be operative such that the part of the unitary device is received in the recess in the piston towards the end of an exhaust stroke of the cycle.

More specifically, the unitary device may be configured to substantially fill the recess in the piston.

Alternatively or in addition, the unitary device may be actuated by means of at least one solenoid.

More specifically, the solenoid may be controlled to provide for synchronisation with an operating cycle of the internal combustion engine.

Alternatively or in addition, the internal combustion engine may further comprise a fluid injection pump comprising a pump member operative to pump fluid by moving within a housing of the fluid injection pump, in which a piston situated in a cylinder of the internal combustion engine cooperates, when in use, with the pump member to actuate the pump member as the piston moves in the cylinder.

More specifically, the housing may define a space and the pump member may be operative to move bodily within the space.

More specifically, the pump member and housing may be configured to create a fluid tight seal between the housing and the pump member as the pump member moves.

Alternatively or in addition, the internal combustion engine may be configured to synchronise movement of the pump member within the housing with a combustion cycle.

In a form of the present invention, the space may comprise a priming portion and an injecting portion and the pump member may be operative to move between the priming portion and the injecting portion.

More specifically, the housing may define a fluid inlet, the fluid inlet being closed when the pump member is situated in the priming portion and being open when the pump member is situated in the injecting portion.

More specifically, the fluid injection pump may be configured to create a vacuum as the pump member moves from the priming portion to the injecting portion.

Alternatively or in addition, the internal combustion engine may further comprise fluid metering means. The fluid metering means may be operative to provide a predetermined, perhaps controllable measure of fluid to the fluid injection device.

Alternatively or in addition, the fluid metering means may be operative to pump fluid from a fluid supply to the fluid injection pump.

Alternatively or in addition, the fluid injection pump may be configured to transfer fluid from the priming portion to the injecting portion as the pump member moves from the injecting portion to the priming portion.

More specifically, movement of the pump member may actuate the transfer of fluid from the priming portion to the injecting portion.

More specifically, the fluid injection pump may comprise a fluid conduit between the priming portion and the injecting portion and the pump member and housing may be configured to form a fluid tight seal with the housing as the pump member moves.

Alternatively or in addition, the internal combustion engine may further comprise at least one fluid outlet to the cylinder, the fluid outlet being in fluid communication with the injecting portion, and the pump member and housing may be configured to form a fluid tight seal with each other as the pump member moves from the priming portion to the injecting portion.

In a further form of the present invention, the fluid injection pump may be provided in the piston.

More specifically, the body of the piston may define the housing of the fluid injection pump.

More specifically, the housing and the pump member may be configured to constrain movement of the pump member within the housing in a direction substantially in line with a longitudinal axis of the bore of the cylinder.

Alternatively or in addition, the internal combustion engine may further comprise a plurality of fluid outlets to the cylinder, the fluid outlets being in fluid communication with the fluid injection pump and configured to provide a dispersion of fluid within the cylinder.

Alternatively or in addition, the fluid injection pump may be configured to pump combustion fuel.

Alternatively or in addition, the internal combustion engine may comprise combustion ignition means operative to generate a source of ignition within a cylinder of the internal combustion engine, in which the combustion ignition means is configured to generate a diffuse source of ignition.

More specifically, the combustion ignition means may comprise an optical energy generator for generating optical energy as the source of ignition.

More specifically, the optical energy generator may comprise a laser.

Alternatively or in addition, the combustion ignition means may comprise an energy conductor (e.g. a fibre optic cable) for conveying the source of ignition from the optical energy generator to the cylinder.

Alternatively or in addition, the combustion ignition means may comprise diffusion means for converting a point source of ignition to a diffuse source of ignition.

Alternatively or in addition, where the internal combustion engine comprises a unitary device comprising an air intake valve and an exhaust valve, the combustion ignition means may be provided in the unitary device.

Alternatively or in addition, the internal combustion engine may further comprise combustion ignition means operative to generate a source of ignition within a cylinder of the internal combustion engine, in which the combustion ignition means comprises a laser and the source of ignition is laser light.

Alternatively or in addition, the internal combustion engine may further comprise combustion ignition means operative to generate a source of ignition within a cylinder of the internal combustion engine, in which the combustion ignition is configured to generate a diffuse source of ignition.

Alternatively or in addition, the internal combustion engine may comprise a petrol engine or a compression-ignition engine, such as a diesel engine, or indeed a gas engine.

The present applicant has realised that providing an exhaust gas aperture in the vicinity of the piston when the piston is situated in the cylinder towards the end of the expansion stroke has wider application than hitherto described.

Therefore, according to a fourth aspect of the present invention there is provided an internal combustion engine having a combustion cycle of at least four strokes comprising an exhaust gas aperture provided in a cylinder of the internal combustion engine, the internal combustion engine being configured to close the exhaust gas aperture at least during a compression stroke of a cycle and to open the exhaust gas aperture towards the end of an expansion stroke of the cycle as a piston moves in the cylinder, wherein the exhaust gas aperture is in the vicinity of the piston when the piston is towards the end of the expansion stroke.

Conventionally, combustion products are exhausted from a cylinder by opening an exhaust port located towards the top of the cylinder when the piston reaches the end of the expansion stroke. Opening an exhaust gas aperture that is in the vicinity of the piston towards the end of the expansion stroke according to the invention can relieve the pressure of combustion gases in the cylinder. This may have the advantage of reducing resistance encountered by the piston as it moves on its return stroke after completion of the expansion stroke. Also, exhaust valves can be exposed to significantly lower temperature and/or pressure gases than in conventional arrangements.

More specifically, the internal combustion engine may be configured such that the exhaust gas aperture is opened and closed by movement of the piston in the cylinder during the course of the cycle.

More specifically, the piston may be operative to move from a position at which it covers the exhaust gas aperture to another position at which it uncovers the exhaust gas aperture.

Alternatively or in addition, the internal combustion engine may be configured to change a length of a stroke of the piston in the cylinder from one stroke to another during a cycle, the exhaust gas aperture opening during a longer length of stroke of the piston.

More specifically, the internal combustion engine may be operative according to a four stroke cycle and may further comprise a crankshaft rotatable about a crankshaft axis, a connecting rod in engagement towards a first end with a throw of the crankshaft and coupling towards a second end to the piston, in which the connecting rod and crankshaft are configured to change a distance between the crankshaft axis and the piston from a point during a revolution of the crankshaft within a combustion cycle to the same point during a subsequent revolution of the crankshaft within the combustion cycle.

Alternatively or in addition, the internal combustion engine may further comprise an exhaust port located towards a top of the cylinder which is operable in accordance with conventional practice.

Further forms of the fourth aspect of the present invention may comprise one or more features of one or more other aspects of the present invention.

According to a fifth aspect of the present invention there is provided a method of relieving exhaust gas pressure in a cylinder of an internal combustion engine having a combustion cycle of at least four strokes comprising:

providing an exhaust gas aperture in the cylinder such that it is in the vicinity of a piston when the piston is situated in the cylinder towards the end of an expansion stroke of a cycle, and configuring the internal combustion engine to close the exhaust gas aperture at least during a compression stroke of the cycle and to open the exhaust gas aperture towards the end of an expansion stroke of the cycle.

Forms of the fifth aspect of the present invention may comprise one or more features described above in respect of the fourth aspect.

The present applicant has realised that using the piston to compress air for use in combustion has wider application than hitherto described.

Therefore, according to a sixth aspect of the present invention there is provided an internal combustion engine having a combustion cycle of at least four strokes comprising:

a substantially air-tight space defined by a part of the internal combustion engine, the space being in fluid communication with a piston moveably situated in a cylinder of the internal combustion engine such that, in use, air within the space is compressed as the piston moves toward the open end of the cylinder, and the internal combustion engine is configured to open an aperture to the space after compression of the air, the aperture being in fluid communication with an air intake to the cylinder, whereby compressed air is released from the space to the cylinder.

Compression by the piston of air contained within the space can provide for injection of air, e.g. combustion air, into the cylinder without having to rely on conventional means, such as a turbocharger or supercharger. Thus, the present approach can make fuller use of energy released during a combustion cycle and may therefore provide for more efficient engine operation. In addition, increasing the density of the intake charge and hence the power output of the engine can lead to one or more of smaller engine size, lighter engine weight and a less expensive engine for a required power output.

More specifically, the internal combustion engine may be configured to open the aperture by movement of the piston in the cylinder during the course of a cycle, e.g. a combustion cycle.

More specifically, the piston may be operative to move from a position at which it covers the aperture to another position at which it uncovers the aperture.

Alternatively or in addition, the piston may define a conduit which is open to the space at an end and is in fluid communication at another end with the aperture during part of the movement of the piston in the cylinder.

Alternatively or in addition, the internal combustion engine may be configured to open a further aperture to the space before air is compressed in the space. Thus, air (e.g. atmospheric air) may be admitted to the space prior to compression.

More specifically, the internal combustion engine may be configured to open the further aperture by movement of the piston in the cylinder.

More specifically, the piston may operative to move from a position at which it covers the further aperture to another position at which it uncovers the further aperture.

More specifically, the piston may define a further conduit which is open to the space at an end and is in fluid communication at another end with the further aperture during part of the movement of the piston in the cylinder.

Alternatively or in addition, the space defined by the part of the internal combustion engine may comprise a crankcase.

Typically, the bottom of a crankcase contains oil for machine lubrication. The applicant has realised that under certain circumstances the oil may release a vapour which may contaminate the air compressed in the crankcase. Therefore and more specifically, the internal combustion engine may further comprise a dry sump. A dry sump is a sump which does not contain lubrication oil. Alternatively or in addition, the internal combustion engine may further comprise a trap for trapping oil vapour contained within air compressed within the crankcase. More specifically, the trap may be located between the aperture and the air intake to the cylinder.

Alternatively or in addition, the internal combustion engine may comprise a plurality of cylinders each cylinder having a substantially air-tight space associated with it and an aperture for releasing compressed air to an air intake of the cylinder.

Alternatively or in addition, fluid communication between the aperture and the air intake may be by means of an air intake conduit. More specifically, the air intake conduit may comprise an air-to-air intercooler chamber external to the chamber block. Alternatively or in addition, the air intake may comprise a non-return valve, such as a pressure differential flapper or reed valve.

Alternatively or in addition, the internal combustion engine may be configured to change a length of a stroke of the piston in the cylinder from one stroke to another during a cycle, the air in the space being compressed to a higher pressure during a longer length of stroke of the piston.

Alternatively or in addition, the internal combustion engine may comprise a non-return valve for trapping air compressed in the space.

More specifically, the non-return valve may be configured to release compressed air from the space. For example, compressed air may be released for induction into the cylinder.

Alternatively or in addition, the internal combustion engine may comprise an internal combustion engine in which the air intake to the cylinder is a combustion air intake.

More specifically, the internal combustion engine may comprise a petrol engine or a compression-ignition engine, such as a diesel engine.

Alternatively or in addition, the internal combustion engine may be operative to perform a four stroke combustion cycle.

More specifically, at least one of the piston and the part of the internal combustion engine may be configured to open the aperture at about the transition between the suction and compression strokes.

More specifically where the internal combustion engine comprises a further aperture, at least one of the piston and the part of the internal combustion engine may be configured to open the further aperture at about the transition between the compression and expansion strokes.

Forms of the sixth aspect of the present invention may comprise one or more features described in respect of one or more other aspects of the present invention.

According to a seventh aspect of the present invention there is provided a method of injecting air into a cylinder of an internal combustion engine having a combustion cycle of at least four strokes comprising:

providing a substantially air-tight space defined by a part of the internal combustion engine, the space being in fluid communication with a piston moveably located in the cylinder such that, in use, air within the space is compressed as the piston moves toward the open end of the cylinder, and configuring the internal combustion engine to open an aperture to the space after compression of the air, the aperture being in fluid communication with an air intake on the cylinder, thereby releasing compressed air from the space to the cylinder.

Forms of the seventh aspect of the present invention may comprise one or more features defined in respect of the sixth aspect of the present invention.

The present applicant has realised that a unitary device comprising an air intake valve and an exhaust valve has wider application than hitherto described.

Therefore, according to an eighth aspect of the present invention, there is provided a reciprocating machine comprising a unitary device comprising a fluid intake valve and a fluid outlet valve, the unitary device being operable during an operating cycle of the reciprocating machine to move in relation to a cylinder of the reciprocating machine to open a fluid intake aperture to the cylinder and to open a fluid outlet aperture to the cylinder.

The unitary device of the present invention may confer advantages, e.g. over the conventional rocker arm and separate intake valve and exhaust valve arrangement of an internal combustion engine, by simplifying the valve structure, which in turn may provide for ease of manufacture and lower cost.

More specifically, the unitary device may be operable to move to a first position at which neither the fluid intake aperture nor the fluid outlet aperture is open, to a second position at which the fluid intake aperture is open and the fluid outlet aperture is closed and to a third position at which the fluid intake aperture is closed and the fluid outlet aperture is open.

More specifically, the unitary device may be operable to move from one of the three positions to another by substantially linear movement in relation to the cylinder.

Alternatively or in addition, the unitary device may be configured to prevent the unitary device falling into the cylinder. This feature may be useful in the event of an electrical power failure or electronic control failure.

Alternatively or in addition, the unitary device may be operable to move substantially in a direction of a longitudinal axis of a bore of the cylinder.

Alternatively or in addition, the unitary device may define at least one conduit for each of fluid intake and fluid expulsion, each conduit being brought into fluid communication with the cylinder during the course of the operating cycle of the reciprocating machine.

Alternatively or in addition, the cylinder and the unitary device may be configured for movement of at least part of the unitary device into the cylinder bore during the cycle.

More specifically, the unitary device may be moveable to a first position in the cylinder bore at which the fluid intake aperture is opened.

More specifically, the unitary device may be moveable to a second position in the cylinder bore at which the fluid outlet aperture is opened.

More specifically, the unitary device may be operable to reach further into the bore at the second position than at the first position.

Alternatively or in addition, the piston and unitary device may be configured such that part of one is received in the other during the course of the cycle.

More specifically, the piston may define a recess configured to receive at least a part of the unitary device. This feature allows for the recess to be of such a volume to provide a desired compressed volume. This can address the infinite compression ratio problem encountered during the following compression stroke. In addition, the presence of the recess can prevent contact between the piston and the unitary device in the event of a failure, such as electrical power, solenoid or control electronics failure.

More specifically, the unitary device and piston may be operative such that the part of the unitary device is received in the recess in the piston towards the end of an exhaust stroke of the cycle. Where the reciprocating machine is an internal combustion engine this can aid more complete scavenging of exhaust gases from the cylinder.

More specifically, the unitary device may be configured to substantially fill the recess in the piston.

Alternatively or in addition, the unitary device may be actuated by means of at least one solenoid.

More specifically, the solenoid may be controlled to provide for synchronisation with the operating cycle of the reciprocating machine.

Alternatively or in addition, the unitary device may be controlled in dependence upon engine speed and/or load demand, e.g. by means of the engine's electronic management system. Controlling the speed and or degree of opening of the unitary device during the intake cycle to correctly match the intake volume with the fuel charge supply can avoid there being too lean an air-fuel mixture and subsequent excessive combustion temperatures.

Alternatively or in addition, the fluid intake valve and a fluid outlet valve may be configured to utilise circular porting for both inlet and outlet movements. This can provide for thermal symmetry and even radial expansion which allows the unitary device to have a light and robust structure.

Alternatively or in addition, the unitary device may be configured such that its valve porting and/or its passage geometry provides for release of exhaust gas contained within the unitary device.

Alternatively or in addition, the reciprocating machine may comprise an internal combustion engine in which the fluid intake valve is an air intake valve, the fluid outlet valve is an exhaust valve, the fluid intake aperture is a fluid intake aperture and the fluid outlet aperture is an exhaust gas aperture.

This aspect of the invention may also be applicable to pumps as well as motors, such as the internal combustion engine. Indeed this aspect may be applicable to any apparatus involving valve/porting in the control of movement of fluids and/or gases. Thus, the reciprocating machine may alternatively comprise a pump.

Further forms of the eighth aspect of the invention may comprise one or more features described in respect of one or more of the other aspects of the present invention.

The present applicant has realised that having a pump member which is actuated by movement of a piston of an internal combustion engine has wider application than hitherto described.

Therefore, according to a ninth aspect of the present invention there is provided an internal combustion engine having a combustion cycle of at least two strokes comprising:

a fluid injection pump comprising a pump member operative to pump fluid by moving within a housing of the fluid injection pump, in which a piston situated in a cylinder of the internal combustion engine cooperates mechanically, when in use, with the pump member to actuate the pump member as the piston moves in the cylinder.

Making use of the movement of the piston as it moves to and fro within the cylinder to actuate the fluid injection pump can be more efficient than the conventional approach of actuating a fluid injection pump by dedicated means, such as an electricity supply.

More specifically, the housing may define a space and the pump member may be operative to move bodily within the space.

More specifically, the pump member and housing may be configured to create a fluid tight seal between the housing and the pump member as the pump member moves.

Alternatively or in addition, the internal combustion engine may be configured to synchronise movement of the pump member within the housing with a combustion cycle.

In a form of the present invention, the space may comprise a priming portion and an injecting portion and the pump member may be operative to move between the priming portion and the injecting portion.

More specifically, the housing may define a fluid inlet, the fluid inlet being closed when the pump member is situated in the priming portion and being open when the pump member is situated in the injecting portion. Thus, fluid can be admitted to the fluid injection pump prior to injection.

More specifically, the fluid injection pump may be configured to create a vacuum as the pump member moves from the priming portion to the injecting portion. The vacuum can help draw fluid into the fluid injection pump.

Alternatively or in addition, the internal combustion engine may further comprise fluid metering means. The fluid metering means may be operative to provide a predetermined, perhaps controllable measure of fluid to the fluid injection device. Alternatively or in addition, the fluid metering means may be operative to pump fluid from a fluid supply to the fluid injection pump.

Alternatively or in addition, the fluid injection pump may be configured to transfer fluid from the priming portion to the injecting portion as the pump member moves from the injecting portion to the priming portion.

More specifically, movement of the pump member may actuate the transfer of fluid from the priming portion to the injecting portion.

More specifically, the fluid injection pump may comprise a fluid conduit between the priming portion and the injecting portion and the pump member and housing may be configured to form a fluid tight seal with the housing as the pump member moves. Thus, movement of the pump member from the injecting portion to the priming portion may pump fluid from the priming portion to the injecting portion via the fluid conduit.

Alternatively or in addition, the internal combustion engine may further comprise at least one fluid outlet to the cylinder, the fluid outlet being in fluid communication with the injecting portion, and the pump member and housing being configured to form a fluid tight seal with each other as the pump member moves from the priming portion to the injecting portion. Thus, fluid may be injected from the injecting portion into the cylinder by movement of the pump member within the housing.

In a further form of the present invention, the fluid injection pump may be provided in the piston.

More specifically, a body of the piston may define the housing of the fluid injection pump.

More specifically, the housing and the pump member may be configured to constrain movement of the pump member within the housing in a direction substantially in line with a longitudinal axis of the bore of the cylinder. Thus, the pump member may be thrown to and fro within the housing as the piston moves to and fro within the cylinder.

Alternatively or in addition, the internal combustion engine may further comprise a plurality of fluid outlets to the cylinder, the fluid outlets being in fluid communication with the fluid injection pump and being configured to provide a dispersion of fluid within the cylinder. The plurality of fluid outlets can provide for the injection of an atomised charge of fuel into the cylinder thereby setting up an advantageous combustion environment in the cylinder.

Alternatively or in addition, the fluid injection pump may be configured to pump combustion fuel.

More specifically, the fluid injection pump may be configured to alternately pump combustion fuel and air. This can reduce leakage of fuel down the cylinder wall into the crankcase.

Movement of the pump member towards the end of the exhaust stroke/beginning of the intake stroke can purge the fluid injection pump of combustion fuel, e.g. fuel that has leaked back into the fluid injection pump after injection of fuel by the pump into the cylinder.

Alternatively or in addition, the internal combustion engine may be a petrol engine or a compression-ignition engine, such as a diesel engine.

Further forms of the ninth aspect of the present invention may comprise one or more features of one or more of the other aspects of the present invention.

According to a tenth aspect of the present invention, there is provided a method of actuating a fluid injection pump in an internal combustion engine having a combustion cycle of at least two strokes, the method comprising:

providing a fluid injection pump comprising a pump member operative to pump fluid by moving within a housing of the fluid injection pump, and configuring a piston situated in a cylinder of the internal combustion engine to cooperate mechanically, when in use, with the pump member to actuate the pump member as the piston moves in the cylinder.

Further forms of the tenth aspect of the present invention may comprise one or more features of the ninth aspect of the present invention.

The present applicant has realised that using a diffuse source of ignition in an internal combustion engine has wider application than hitherto described.

Therefore, according to an eleventh aspect of the present invention there is provided a reciprocating internal combustion engine having a combustion cycle of at least two strokes comprising combustion ignition means operative to generate a source of ignition within a cylinder of the internal combustion engine, in which the combustion ignition means is configured to generate a diffuse source of ignition.

Igniting an air-fuel mixture in a cylinder by means of a diffuse source of ignition can provide for more effective combustion and/or a reduction on stresses exerted on the internal combustion engine. This is because an efficient and 'clean burn' of combustion gases can be achieved by providing a large flame front during burn. In a conventional internal combustion engine the flame front originates from (one or more) electrical discharge spark plugs which must be located centrally within the cylinder head for maximum effect. The spark plug and the associated electrical control and distribution system can be a major source of maintenance failure (e.g. dampness problems at high tension connectors and insulators) and limited life on account of contamination of insulators and continual and progressive electrical erosion of the spark gap. This in turn can weaken the spark density and cause a minute delay in optimal 'timing' of the spark discharge. In addition, ignition using the conventional spark plug can cause a combustion ripple though the cylinder which may provide for less effective combustion and generate undesirable stresses.

More specifically, the combustion ignition means may comprise an optical energy generator for generating optical energy as the source of ignition.

More specifically, the optical energy generator may comprise a laser.

Alternatively or in addition, the combustion ignition means may comprise an energy conductor (e.g. a fibre optic cable) for conveying the source of ignition from the optical energy generator to the cylinder.

More specifically, the optical energy generator may comprise a sealed maintenance laser energy source.

Alternatively or in addition, the combustion ignition means may comprise diffusion means for converting a point source of ignition to a diffuse source of ignition.

Alternatively or in addition, the diffusion means may be located in the wall of the cylinder.

More specifically, the diffusion means may be located such that it is swept by the piston as it moves within the cylinder. Thus, the diffusion means can be self cleaning.

Alternatively or in addition, the source of ignition may be configured to discharge radially into the bore of the cylinder. Thus, the flame front can accelerate through the bore of the cylinder to provide for full and relatively instantaneous combustion.

Alternatively or in addition, the laser light may be configured to impinge directly on the air-fuel mixture.

Alternatively or in addition, the internal combustion engine may be a petrol engine or a compression-ignition engine, such as a diesel engine.

Where the internal combustion engine is a compression-ignition engine, e.g. a diesel engine, the combustion ignition means may be operative to generate a source of ignition during cranking of the engine.

Thus, the combustion ignition means can perform the function of conventional means of ignition, such as the glow plug.

Alternatively or in addition, where the internal combustion engine is a compression-ignition engine the combustion ignition means may be operative to generate a source of ignition during running of the engine after the cranking phase is complete.

A combustion ignition means according to the two immediately preceding paragraphs may be independently controllable of a combustion cycle of the internal combustion engine.

Thus, operation of the combustion ignition means need not depend directly on the combustion cycle. This can be advantageous in a compression-ignition engine. A conventional means of ignition in a compression-ignition engine normally involves injection of fuel, such as diesel, into the cylinder at around the top of the compression stroke. When the fuel is injected it vaporises and ignites due to the heat created by compression of the air in the cylinder. Thus, ignition timing may be non-optimal because of its direct dependence on the combustion cycle.

The combustion ignition means can provide further benefits. For example, where the combustion ignition means comprises a laser the laser's inherent controllability can provide for improved heat switch on and switch off characteristics. Also, the ability to direct laser light within the cylinder can provide for improved flame front characteristics thereby providing for more efficient and a cleaner burn of combustion gases.

The combustion ignition means may provide the sole means of ignition or may reduce reliance on or improve upon conventional means of ignition by being provided in addition to such conventional means.

Alternatively or in addition, the internal combustion engine may further comprise a unitary device comprising an air intake valve and an exhaust valve according to another aspect of the present invention, and the combustion ignition means may be provided in the unitary device.

Forms of the eleventh aspect of the present invention may comprise one or more features of one or more of the other aspects of the present invention.

According to a twelfth aspect of the present invention, there is provided a reciprocating internal combustion engine having a combustion cycle of at least two strokes comprising combustion ignition means operative to generate a source of ignition within a cylinder of the internal combustion engine, in which the combustion ignition means comprises a laser and the source of ignition is laser light.

Forms of the twelfth aspect of the present invention may comprise one or more features of one or more of the other aspects of the present invention.

According to a further aspect of the present invention, there is provided a vehicle comprising an internal combustion engine according to any of the previous aspects of the present invention.

For the avoidance of doubt references herein to internal combustion engines are not to be considered as relating to petrol or diesel engines alone but should be considered to include internal combustion engines operating on other appropriate fuels, such as gas.

BRIEF DESCRIPTION OF THE DRAWINGS

Specific embodiments of the present invention will now be described by way of example only and with reference to the following drawings, in which.

DETAILED DESCRIPTION OF EXEMPLARY EMBODIMENTS

Figure 1:
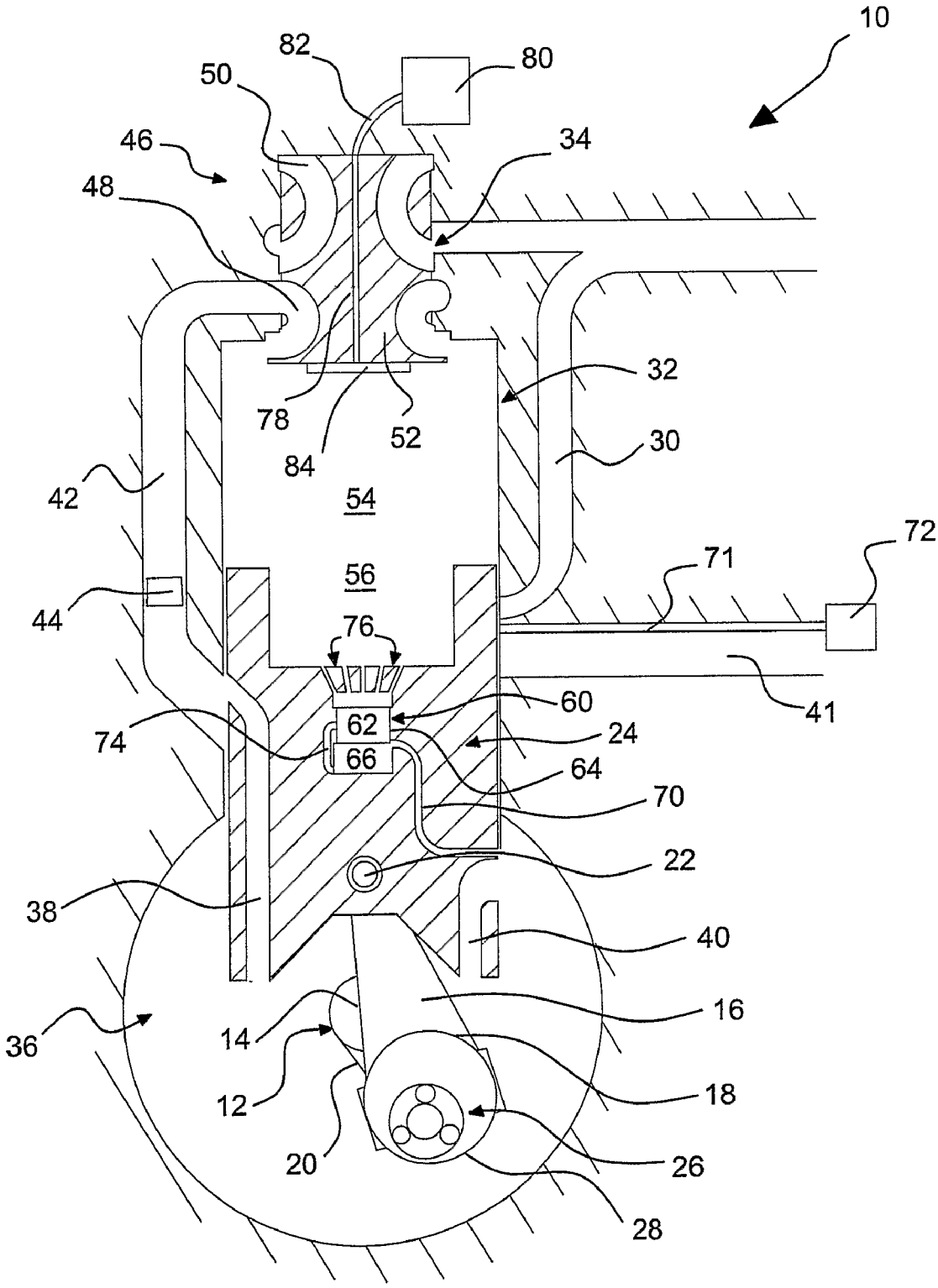
FIG. 1 is a schematic view of an internal combustion engine in accordance with the present invention and during a suction stroke.

Referring now to the drawings, FIG. 1 provides a schematic view of an internal combustion engine 10 in accordance with the present invention and during a suction stroke during a combustion cycle. The internal combustion engine comprises a crankshaft 12 rotatable about a crankshaft axis 14. A connecting rod 16 engages towards a first end 18 with a throw 20 of the crankshaft 12 and couples towards a second end 22 to a piston 24. The first end 18 of the connecting rod 16 engages with the throw 20 by epicyclic gear means 26.

The first end of the connecting rod 16 comprises a connecting rod gear 28 around which the epicyclic gear means 26 and hence the throw 20 of the crankshaft travels. The operation of the epicyclic gear means 26 is described in greater detail below with reference to FIG. 7.

The internal combustion engine 10 of FIG. 1 also comprises an exhaust gas aperture 30 provided in a cylinder 32 of the internal combustion engine. An exhaust gas port 34 is located towards the top of the cylinder.

In addition, the internal combustion engine comprises a crankcase 36 (which constitutes an air-tight space defined by part of the internal combustion engine), within which the crankshaft 12 is situated. The piston 24 defines a first conduit 38 for release of compressed air from the crankcase 36 to the cylinder 32 and a second conduit 40 for admitting atmospheric air to the crankcase. An air intake conduit 42 provides for conveyance of compressed air from the first conduit 38 to the cylinder. A trap 44 is provided in the air intake conduit.

The internal combustion engine 10 also comprises a unitary device 46 comprising an air intake valve 48 and an exhaust valve 50. A leading part 52 of the unitary device is shown in FIG. 1 in the bore 54 of the cylinder 32. The piston has a recess 56 in its leading face opposing the unitary device. A solenoid (not shown) is used to move the unitary device 46.

The internal combustion engine also comprises a combustion fuel injection pump 60 (which constitutes a fluid injection pump), which comprises a pump member 62 in a housing 64 of the pump, and which is defined within the body of the piston 24. The pump member 62 creates a fluid tight seal with the housing 64 as it moves. The space defined by the housing 64 comprises a priming portion 66 and an injecting portion 68 (shown in FIG. 4 only). The housing 64 defines a fluid inlet 70, which registers at a point during the combustion cycle with a further fluid inlet 71 defined in the body of the internal combustion engine. In addition, a fuel metering means 72 is connected to the further fluid inlet 71. A fluid conduit 74 connects the priming portion 66 and the injecting portion 68. A plurality of fluid outlets 76 convey fuel from the injecting portion 68 to the bore 54 of the cylinder.

Combustion ignition means 78 is provided in the unitary device 46. The combustion ignition means 78 comprises a laser 80 (which constitutes an optical energy generator) connected to a fibre optic cable 82 (which constitutes an energy conductor) which in turn is connected to diffusion means 84.

FIG. 1 shows the internal combustion engine during a suction stroke of a four stroke combustion cycle.

Figure 2:
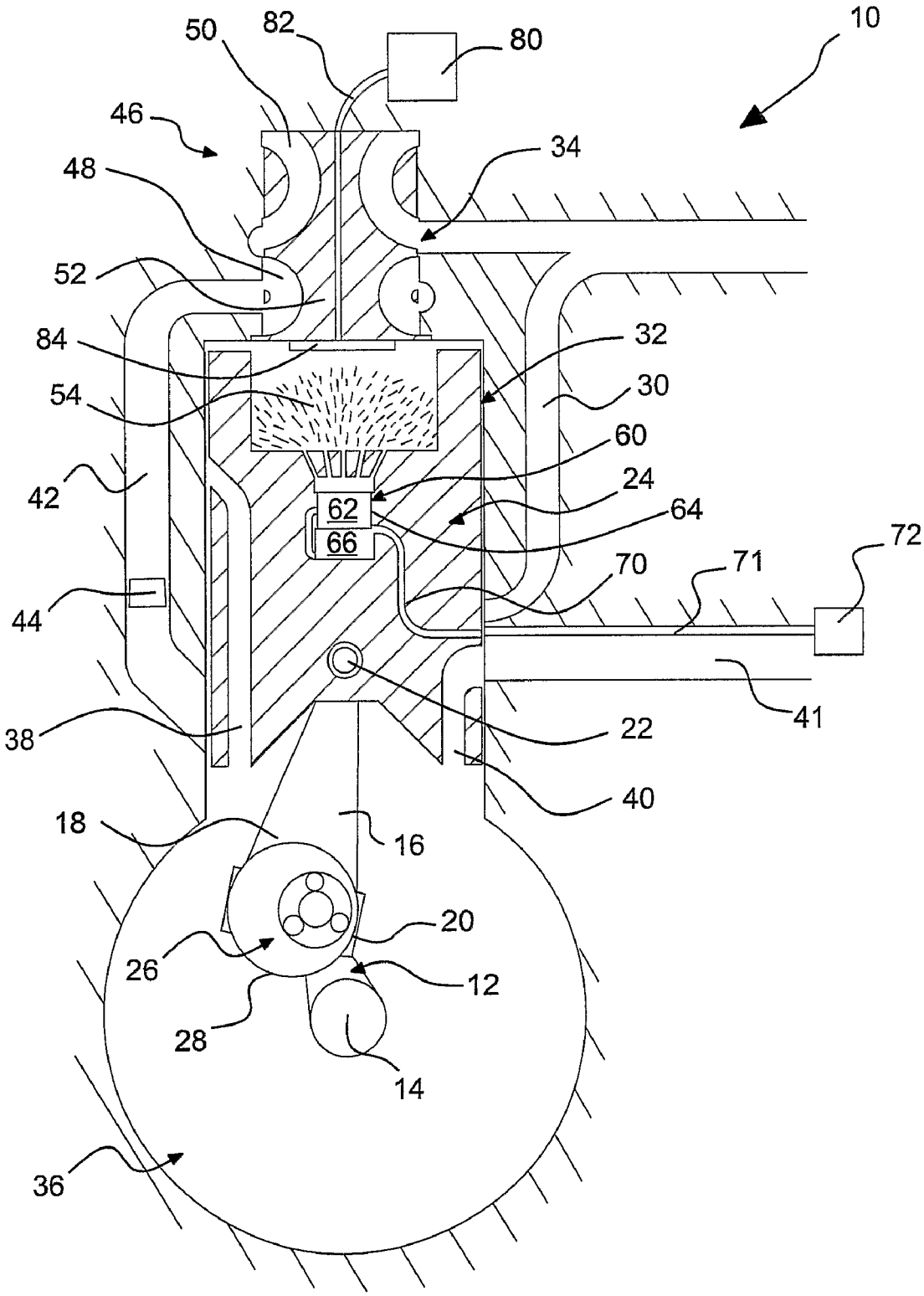
FIG. 2 is a schematic view of the engine of FIG. 1 during a compression stroke.

Turning now to FIG. 2, an internal combustion engine 10 is shown during a compression stroke of a four stroke combustion cycle. The internal combustion engine 10 of FIG. 2 has the same components as FIG. 1 and thus reference should be made to the description given with reference to FIG. 1.

Figure 3:
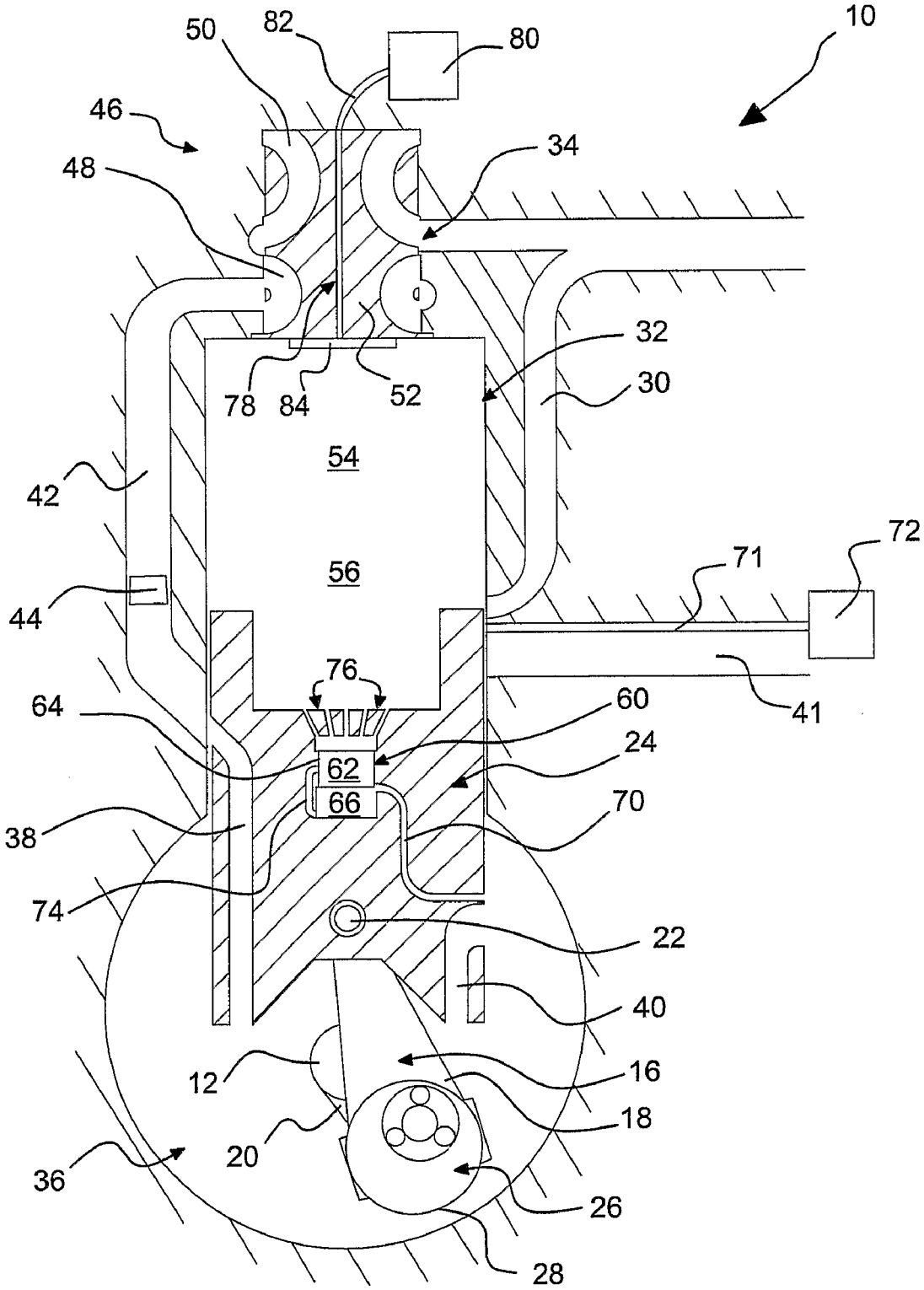
FIG. 3 is a schematic view of the engine of FIG. 1 during an expansion stroke.

Turning now to FIG. 3, an internal combustion engine 10 is shown during an expansion stroke of a four stroke combustion cycle. The internal combustion engine 10 of FIG. 3 has the same components as FIG. 1 and thus reference should be made to the description given with reference to FIG. 1.

Figure 4:
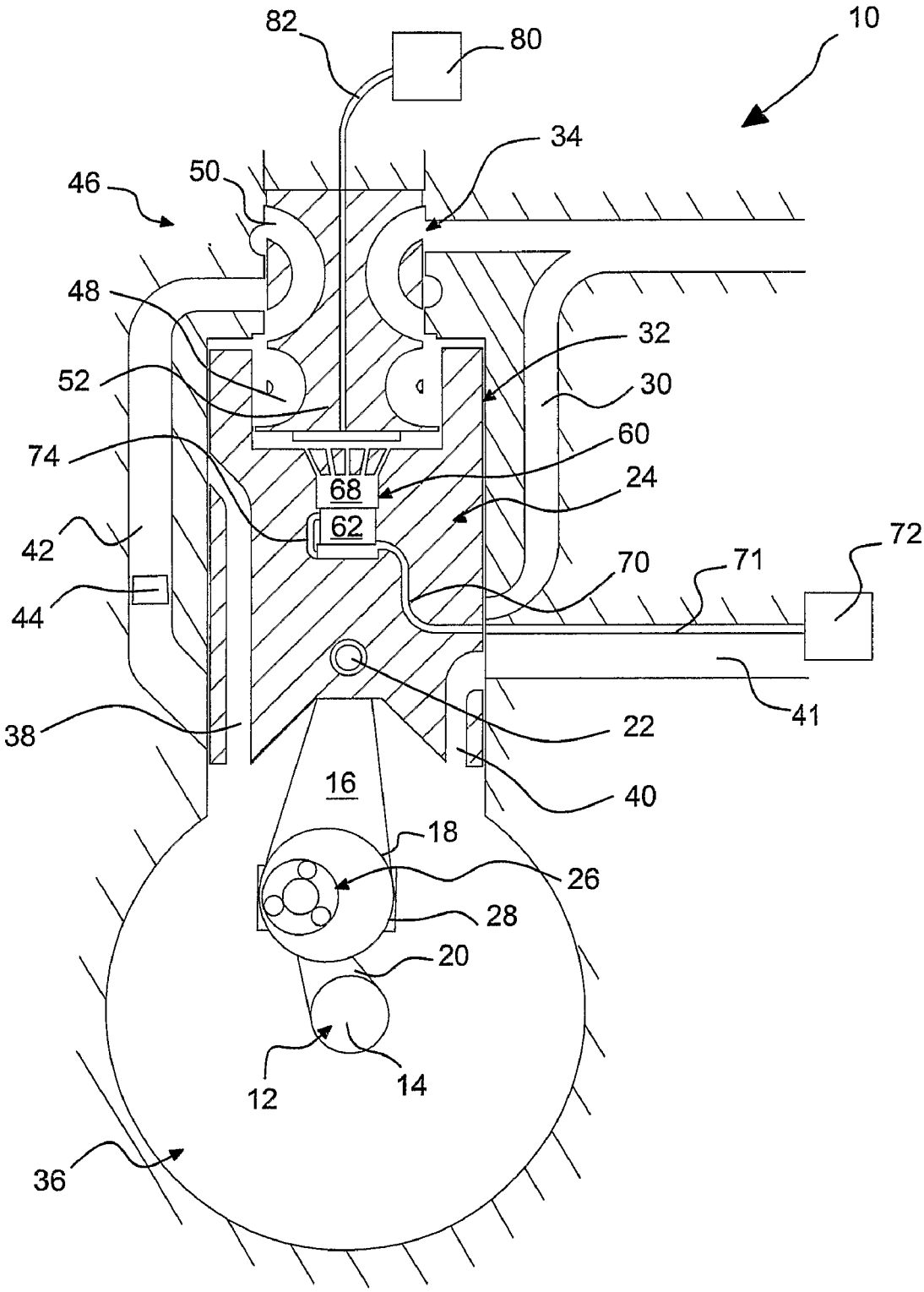
FIG. 4 is a schematic view of the engine of FIG. 1 during an exhaust stroke.

Turning now to FIG. 4, an internal combustion engine 10 is shown during an exhaust stroke of a four stroke combustion cycle. The internal combustion engine 10 of FIG. 4 has the same components as FIG. 1 and thus reference should be made to the description given with reference to FIG. 1.

FIGS. 1 to 4 will be referred below when the operation of the internal combustion engine is described.

Figure 5:
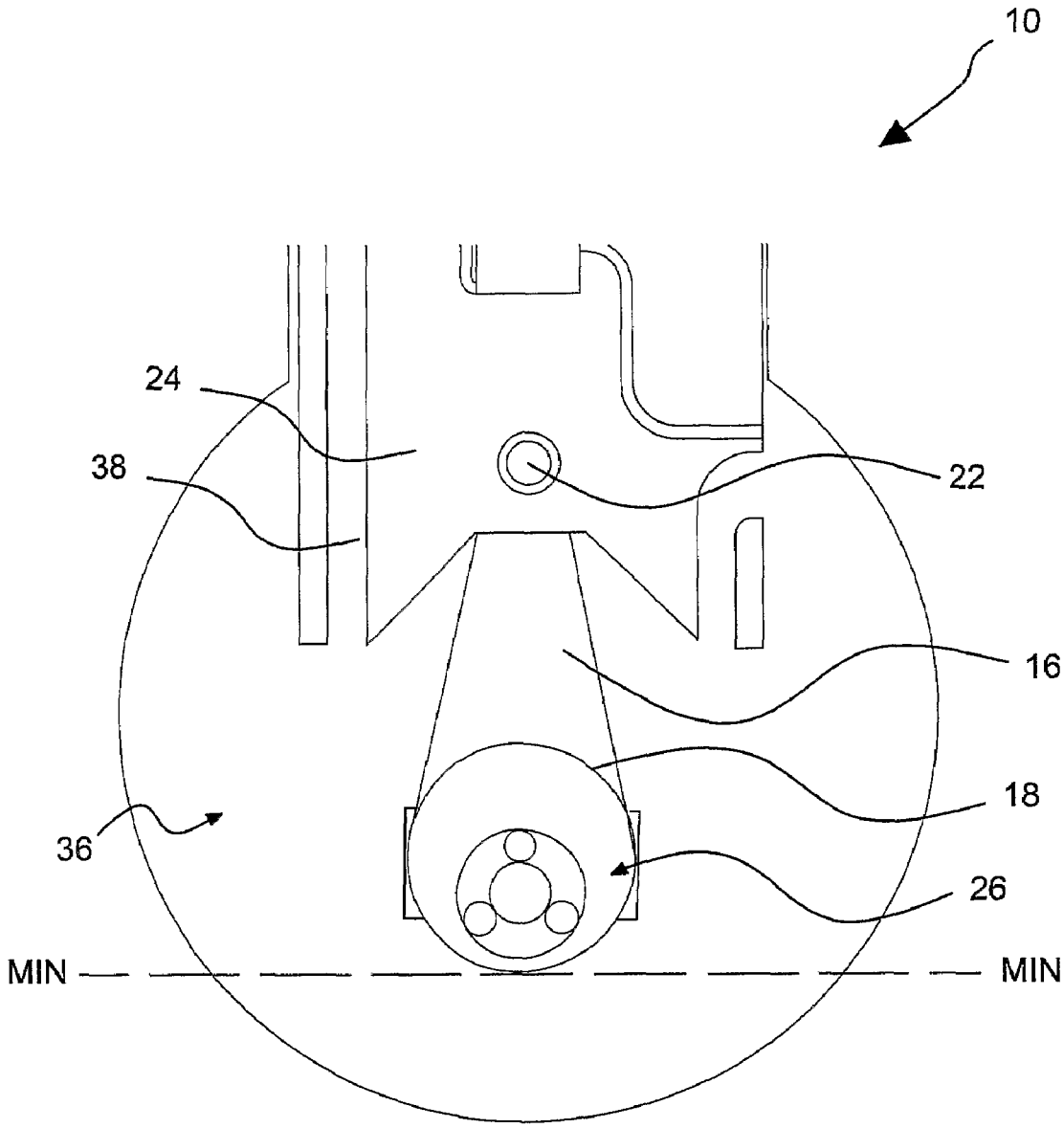
FIG. 5 is a detailed view of the crankcase of FIG. 1 as the piston approaches the transition between a suction stroke and a compression stroke.
Figure 6:
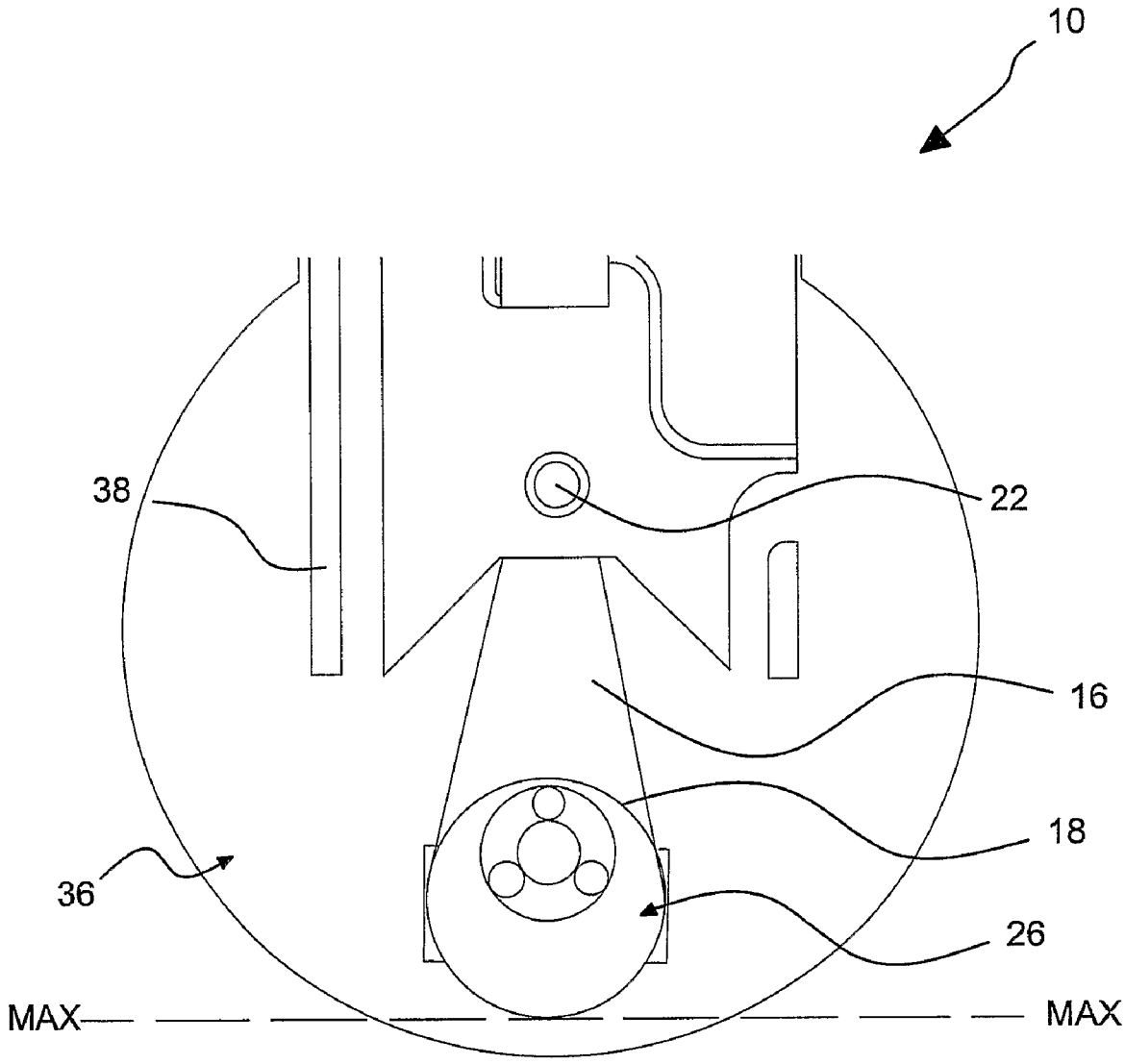
FIG. 6 is a detailed view of the crankcase of FIG. 1 as the piston approaches the transition between an expansion stroke and an exhaust stroke.

FIGS. 5 and 6 provide detailed schematic views of the internal combustion engine of FIGS. 1 to 4 at particular stages during a combustion cycle. The internal combustion engine 10 of FIGS. 5 and 6 have the same components as FIG. 1 and thus reference should be made to the description given with reference to FIG. 1. More specifically, FIG. 5 shows the piston 24 as it approaches the transition from the suction stroke to the compression stroke and FIG. 6 shows the piston 24 as it approaches the transition from the expansion stroke to the exhaust stroke.

The operation of the invention will now be described with reference to FIGS. 1 to 6.

During a suction stroke, as shown in FIG. 1, the unitary device 46 is at a position in which the air intake valve 48 is open to admit air from the air intake conduit 42 to the cylinder bore 54. As the piston drops in the cylinder, air within the crankcase is pressurised. Upon movement of the piston slightly further down in the cylinder beyond the position shown in FIG. 1, the first conduit 38 in the piston aligns with the air intake conduit 42 to allow compressed air to be released from the crankcase into the air intake conduit. As the piston drops in the cylinder the suction thereby created helps draw combustion air into the cylinder. At the end of the stroke, the arrested movement of the piston 24 throws the pump member 62 from the injecting portion 68 to the priming portion 66, whereby fuel contained within the priming portion is pumped from the priming portion to the injecting portion by way of the fluid conduit 74.

At the bottom of the suction stroke the cooperative action of the crankshaft 12 and connecting rod 16 cause the piston to perform an upstroke, i.e. compression stroke. At the start of the compression stroke, the unitary device 46 rises in the cylinder to shut off the air intake and to seal the cylinder as shown in FIG. 2. FIG. 2 shows the internal combustion engine 10 towards the end of the compression stroke, which as regards compression of the cylinder contents is similar to that of a conventional internal combustion engine. As the piston reaches the end of the compression stroke, the second conduit 40 in the piston aligns with an air intake 41 of the engine to admit air, e.g. atmospheric air, to the crankcase. In addition, the pump member 62 is thrown by the arrested movement of the piston 24 from the priming portion 66 to the injecting portion 68, whereby fuel contained within the injecting portion is injected into the bore 54 cylinder by way of the plurality of fluid outlets 76. Movement of the pump member 62 also draws a fresh charge of air into the priming portion 66 of the fuel injection pump.

At the end of the compression stroke, the combustion ignition means 78 operates to ignite the air-fuel mixture contained in the bore 54 of the cylinder and the piston is thrown downwards on its expansion stroke. FIG. 3 shows the piston 24 towards the end of the expansion stroke. As the piston 24 reaches the end of the stroke (i.e. a little further beyond the position shown in FIG. 3) the exhaust gas aperture 30 opens to release combustion products from the cylinder. This relieves the pressure that has built up in the cylinder as a result of combustion. In addition, the pump member 62 is thrown by the arrested movement of the piston from the injecting portion 66 to the priming portion 68.

At the start of the exhaust stroke, the unitary device 46 drops into the cylinder to take up the position shown in FIG. 4, at which the exhaust valve 50 is opened. FIG. 4 shows the internal combustion engine 10 towards the end of the exhaust cycle. As can be seen from FIG. 4, the unitary device is received within the recess 56 in the piston 24 to provide for more complete exhaust gas scavenging. As the piston 24 progresses beyond the position shown in FIG. 4, the second conduit 40 in the piston aligns with an air intake 41 of the engine to admit air, e.g. atmospheric air, to the crankcase. In addition, the fluid inlet 70 registers with the further fluid inlet 71 to admit a charge of fuel from the fuel metering means 72 to the priming portion 66 of the fuel injection pump 60. This completes a combustion cycle in a four-stroke internal combustion engine.

For each complete combustion cycle, the epicyclic gear means 26 and hence the throw 20 performs one complete progression around the connecting rod gear 28. This means that at the transition between the suction and compression strokes, as shown in FIG. 5, the lower edge of the piston drops to the level indicated by the term 'min'. In contrast, at the transition between the expansion and exhaust strokes, as shown in FIG. 6, the lower edge of the piston drops to the level indicated by the term 'max'. Thus, the cylinder displacement is greater during the power producing second half of the combustion cycle than during the first half of the combustion cycle.

Figure 7A:
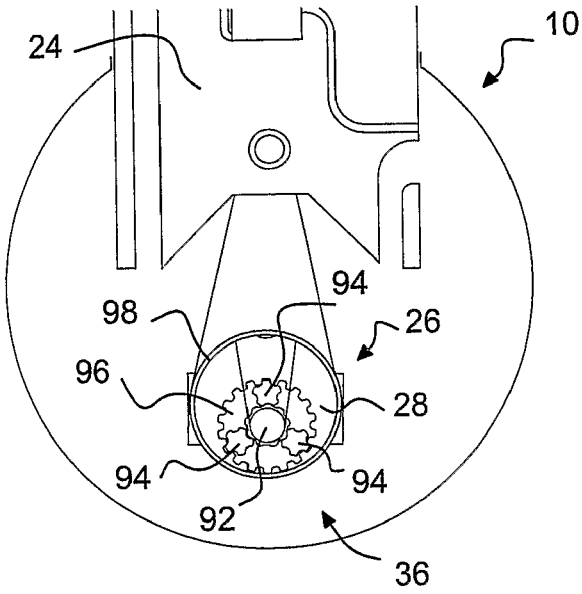
FIGS. 7*a* to 7*c* provide detailed views and illustrate the operation of the epicyclic gear means of FIGS. 1 to 6.
Figure 7B:
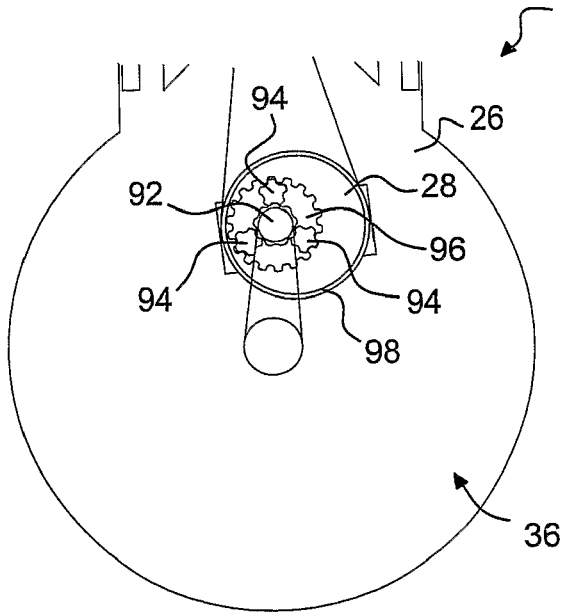
Figure 7C:
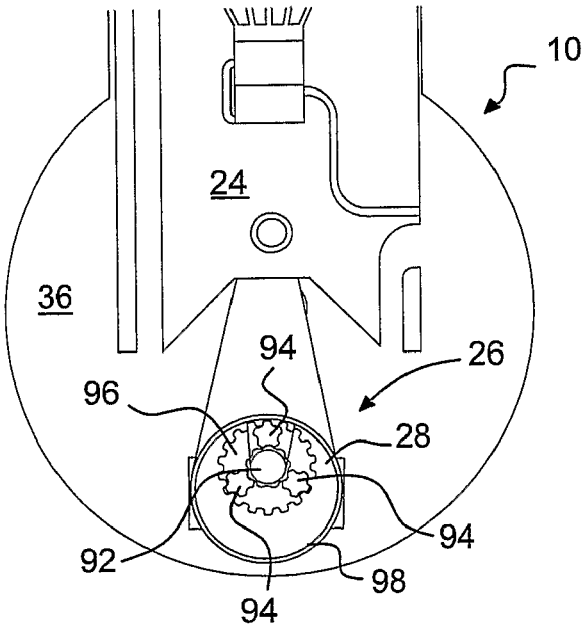

FIGS. 7*a*, 7*b* and 7*c* provide detailed views and illustrate the operation of the epicyclic gear means of FIGS. 1 to 6. With the exception of the specific detail of the epicyclic gear means 26 and the connecting rod gear 28, the parts of the apparatus shown in FIGS. 7*a*, 7*b* and 7*c* are the same as is described above with reference to FIGS. 1 to 6.

As can be seen from FIGS. 7*a* to 7*c*, the epicyclic gear means 26 is located on the throw of the crankshaft and comprises a fixed gear 92 fixedly mounted on the throw and three rotatable gears 94 spaced equally apart around the fixed gear. The fixed gear 92 and the rotatable gears 94 have toothed portions with the toothed portions of the fixed gear engaging with the toothed portions of the rotatable gears. The connecting rod gear 28 defines an aperture 96, the geometric centre of which is offset from the centre of the first end of the connecting rod. It is this offset that provides for the eccentric behaviour of the coupling between the crankshaft and the connecting rod. The internal circumference of the aperture 96 is toothed, with the teeth of the rotatable gears 94 engaging with the teeth of the internal circumference.

The first end of the connecting rod defines a connecting rod gear receiving aperture 98 in which the connecting rod gear 28 is rotatably located.

The operation of the arrangement of FIGS. 7*a* to 7*c* will now be described. FIG. 7*a* shows the arrangement in much the same condition as shown in FIG. 5, i.e. when the piston 24 is at the transition from the suction stroke to the compression stroke at which the lower edge of the piston drops in the crankcase 36 to the minimum level. At this position, the connecting rod gear 28 is oriented in the connecting rod gear receiving aperture 98 such that the aperture 96 is towards the foot of the crankcase, thereby effectively shortening the connecting rod.

As the combustion cycle progresses the arrangement passes through the condition shown in FIG. 7*b*, in which the connecting rod gear 28 has been rotated in the connecting rod gear receiving aperture 98 by the cooperative action of the fixed gear 92 and the rotatable gears 94, and the cooperative action of the rotatable gears 94 and the toothed aperture 96 of the connecting rod gear 28.

At half a complete combustion cycle from the position shown in FIG. 7*a* the arrangement is in the condition shown in FIG. 7*c*, which corresponds to the condition shown in FIG. 6. In this condition the piston 24 is at the transition from the expansion stroke to the exhaust stroke at which the lower edge of the piston drops in the crankcase 36 to the maximum level. At this position, the connecting rod gear 28 is oriented in the connecting rod gear receiving aperture 98 such that the aperture 96 is located towards the piston 24, thereby effectively lengthening the connecting rod.

Figure 8A:
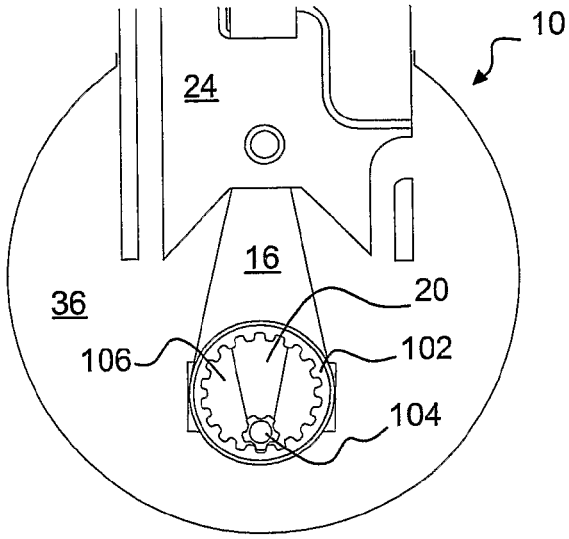
FIGS. 8*a* to 8*c* provide detailed views and illustrate the operation of an alternative embodiment to that of FIGS. 1 to 7*c;*
Figure 8B:
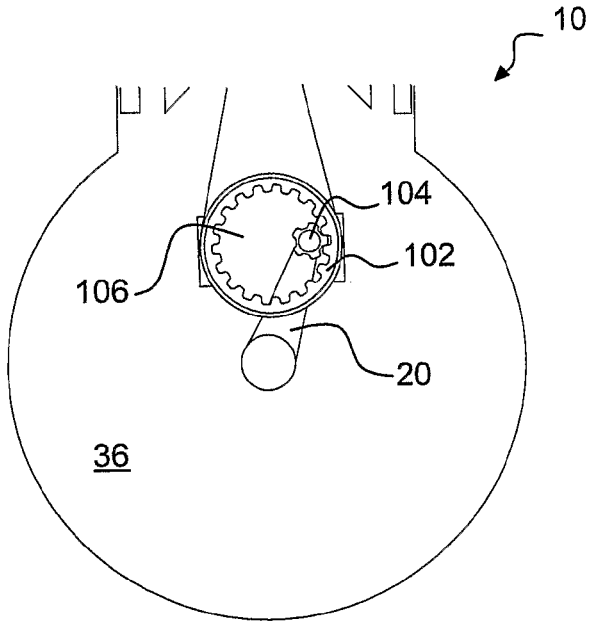
Figure 8C:
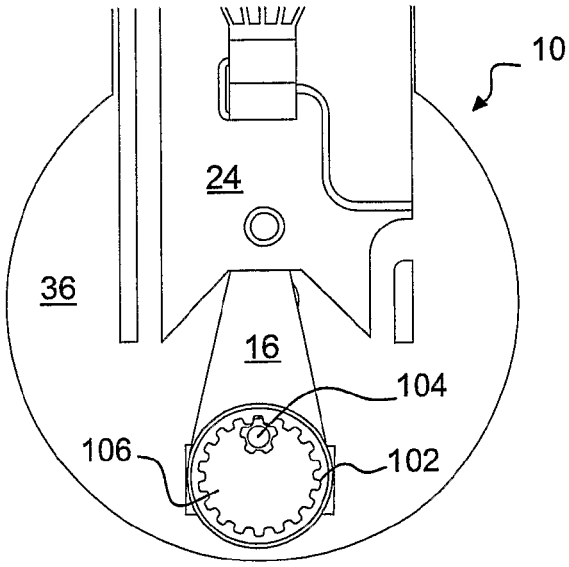

FIGS. 8*a* to 8*c* provide detailed views and illustrate the operation of an alternative embodiment to the epicyclic gear means described above with reference to FIGS. 1 to 7*c*. With the exception of the specific detail of the coupling between the connecting rod and the crankshaft, the parts of the apparatus shown in FIGS. 8*a* to 8*c* are the same as is described above with reference to FIGS. 1 to 6.

As can be seen from FIGS. 8*a* to 8*c*, the first end of the connecting rod 16 comprises a connecting rod gear 102. The connecting rod gear defines an aperture 106 having a toothed circumference and which is concentric with the first end of the connecting rod 16. In addition, the connecting rod gear 102 is mounted so as to allow for its to and fro rotary movement in relation to the first end of the connecting rod. A toothed throw gear 104 is rotatably mounted on the throw 20. The teeth of the throw gear 104 and of the aperture 106 cooperate mechanically.

The operation of the arrangement of FIGS. 8*a* to 8*c* will now be described.

FIG. 8*a* shows the arrangement in much the same condition as shown in FIG. 5, i.e. when the piston 24 is at the transition from the suction stroke to the compression stroke at which the lower edge of the piston drops in the crankcase 36 to the minimum level. At this position, the throw gear 104 has traveled around the toothed aperture 106 such that the throw gear 104 is towards the foot of the crankcase, thereby effectively shortening the connecting rod.

As the combustion cycle progresses the arrangement passes through the condition shown in FIG. 8*b*, at which the throw gear 104 has traveled some distance around the internal circumference of the toothed aperture 106.

At half a complete combustion cycle from the position shown in FIG. 8*a* the arrangement is in the condition shown in FIG. 8*c*, which corresponds to the condition shown in FIG. 6. In this condition the piston 24 is at the transition from the expansion stroke to the exhaust stroke at which the lower edge of the piston drops in the crankcase 36 to the maximum level. At this position, the throw gear 104 has traveled around the internal circumference of the toothed aperture 106 such that the throw gear 104 is located towards the piston 24, thereby effectively lengthening the connecting rod.

Figure 9A:
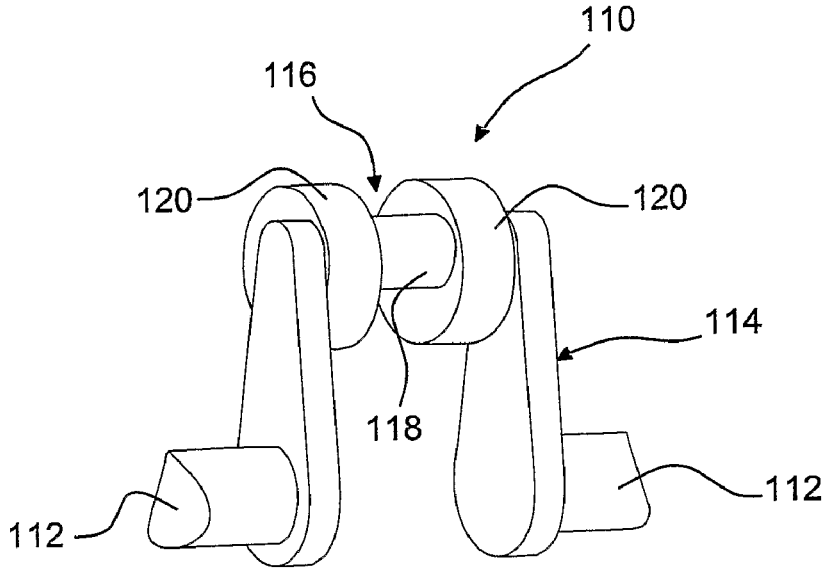
FIGS. 9*a* to 9*c* provide further detailed views of the embodiment of FIGS. 8*a* to 8*c;*
Figure 9B:
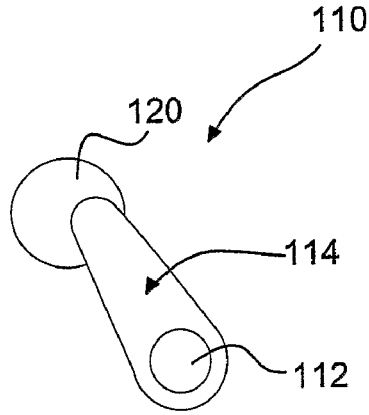
Figure 9C:
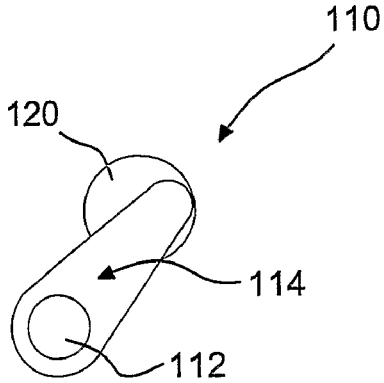

The means by which the throw gear 104 maintains its position in relation to the connecting rod gear 102 during a combustion cycle will now be described with reference to FIGS. 9*a* to 9*c*. A crankshaft 110 is shown in FIGS. 9*a* to 9*c*, having a crankshaft 112 and a throw 114. In between the arms of the throw is provided the crank pin 116. The crank pin 116 is configured as shown in FIG. 9*a* to provide two bearings 118, 120. The first bearing 118 is concentric with the crank pin 116 and the second bearing 120 is eccentric to the crank pin 116. The throw gear (not shown) is mounted on the first bearing 118 and the connecting rod gear (not shown) is mounted on the second bearing 120. FIGS. 9*b* and 9*c* show movement of the eccentric bearing 120 about the axis of the crank pin at two different crank positions during a combustion cycle.

Figure 10A:
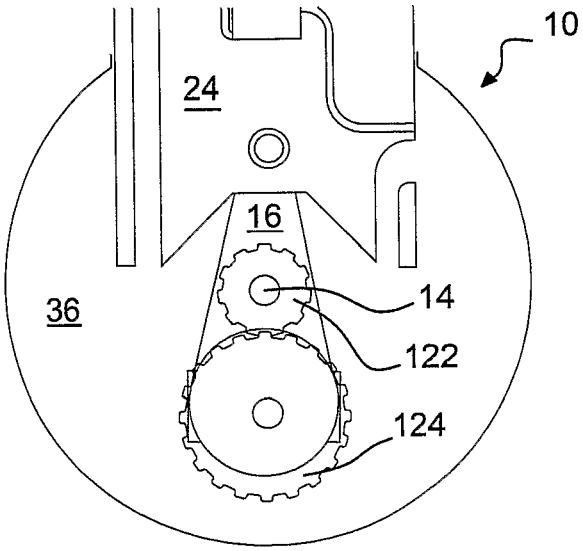
FIGS. 10*a* to 10*c* provide detailed views and illustrate the operation of a further alternative embodiment to those of FIGS. 1 to 9*c;*
Figure 10B:
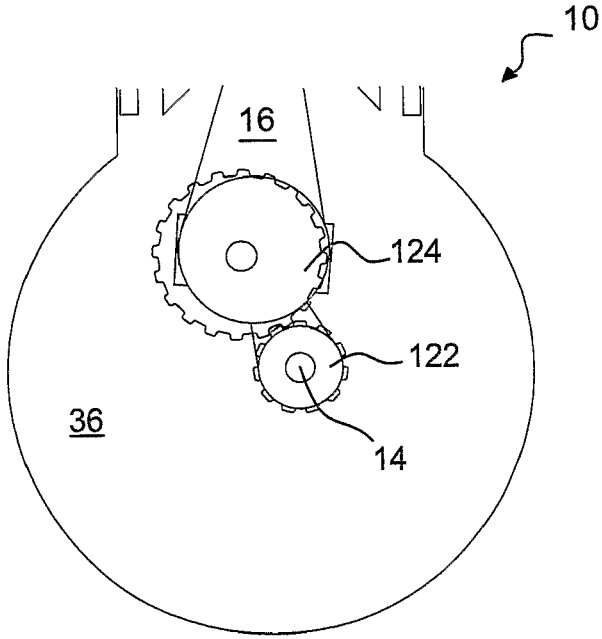
Figure 10C:
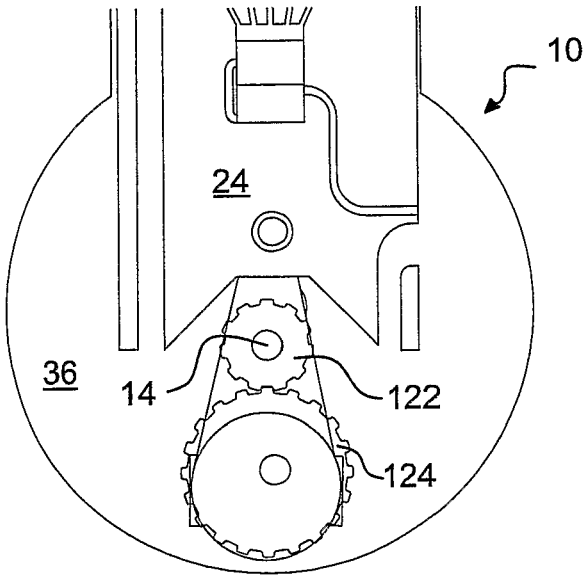

FIGS. 10*a* to 10*c* provide detailed views and illustrate the operation of a further alternative embodiment to the epicyclic gear means described above with reference to FIGS. 1 to 7*c* and to the embodiment described above with reference to FIGS. 8*a* to 9*c*. With the exception of the specific detail of the coupling between the connecting rod and the crankshaft, the parts of the apparatus shown in FIGS. 10*a* to 10*c* are the same as is described above with reference to FIGS. 1 to 6.

As can be seen from FIGS. 10*a* to 10*c*, a toothed crankshaft gear 122 is mounted fixedly and concentrically with the crankshaft axis 14. A toothed connecting rod gear 124, which is of greater diameter than the crankshaft gear 122, is mounted rotatably and eccentrically on the first end of the connecting rod 16. The teeth of the crankshaft gear 122 and of the connecting rod gear 124 engage with each other.

The operation of the arrangement of FIGS. 10*a* to 10*c* will now be described. FIG. 10*a* shows the arrangement in much the same condition as shown in FIG. 5, i.e. when the piston 24 is at the transition from the suction stroke to the compression stroke at which the lower edge of the piston drops in the crankcase 36 to the minimum level. At this position the connecting rod gear 124 has traveled around the crankshaft gear 122 such that the effective length of the connecting rod is at a minimum by virtue of the eccentric position of the connecting rod gear 124 on the connecting rod 16.

As the combustion cycle progresses the arrangement passes through the condition shown in FIG. 10*b*, at which the connecting rod gear 124 has traveled some distance around the external circumference of the crankshaft gear 122.

At half a complete combustion cycle from the position shown in FIG. 10*a* the arrangement is in the condition shown in FIG. 10*c*, which corresponds to the condition shown in FIG. 6. In this condition the piston 24 is at the transition from the expansion stroke to the exhaust stroke at which the lower edge of the piston drops in the crankcase 36 to the maximum level. At this position, the connecting rod gear 124 has traveled around the external circumference of the crankshaft gear 122 to a position at which the effective length of the connecting rod is at a maximum by virtue of the eccentric position of the connecting rod gear 124 on the connecting rod 16.

The embodiment of FIGS. 10*a* to 10*c* can be used alone or in conjunction with either of the first two embodiments.

Figure 11:
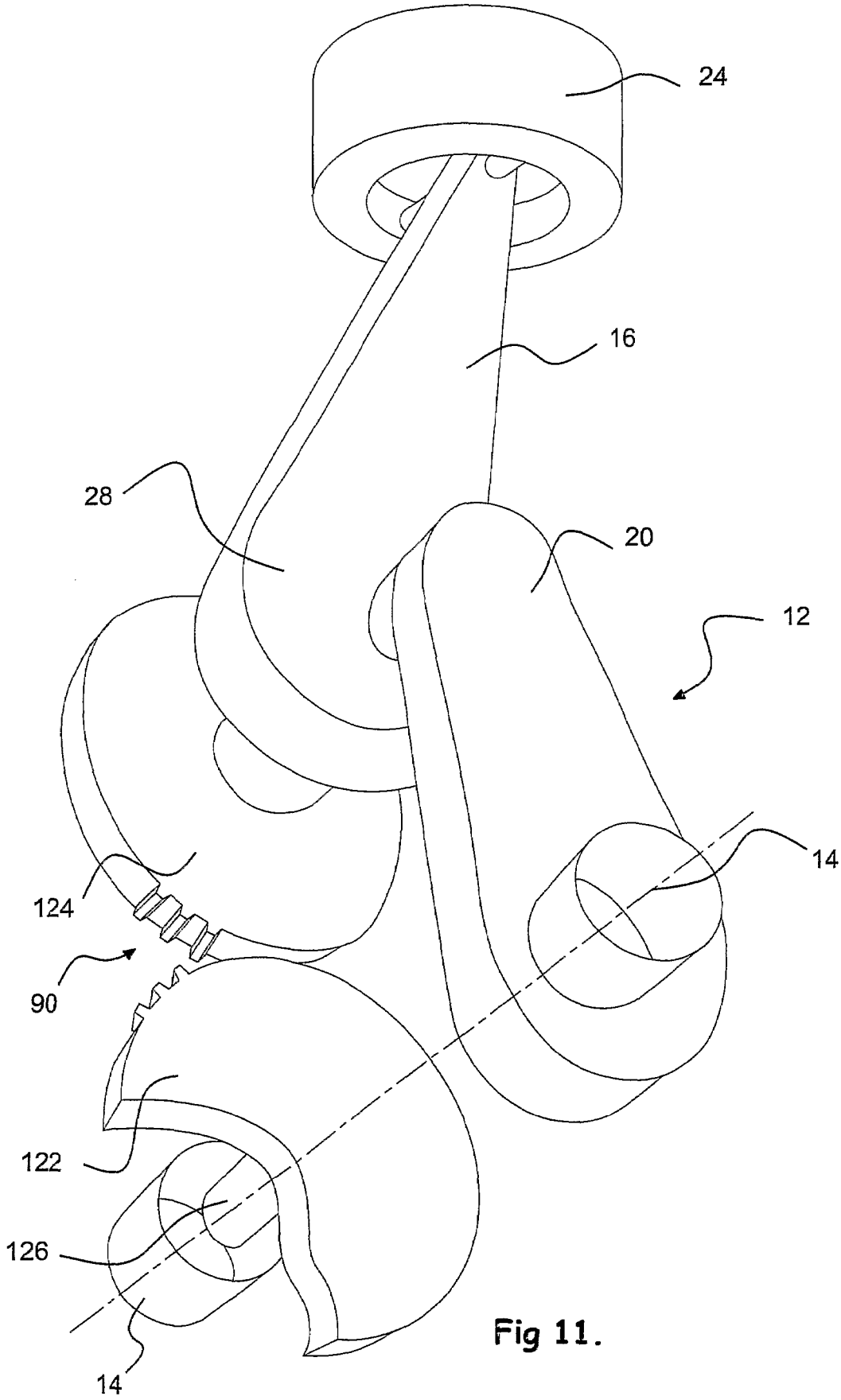
FIG. 11 illustrates a means of external independent control in the embodiment of FIGS. 10*a* to 10*c;*

FIG. 11 is an illustration of a modification of the embodiment of FIGS. 10*a* to 10*c*. FIG. 11 shows a piston 24, which is connected to a connecting rod 16, a crankshaft 12 rotatable around a crankshaft axis 14 and a crankshaft throw 20. FIG. 11 also shows the connecting rod gear 124 and the crankshaft gear 122 of FIGS. 10*a* to 10*c*. The crankshaft has a bore in which a control member 126 is rotatably located. The control member 126 is coupled to the crankshaft gear 122 at one end and is connected at its other end to a mechanical or electromechanical actuator (not shown). Operation of the actuator causes rotation of the control member 126, which rotates the crankshaft gear 122, which in turn rotates the connecting rod gear 124. Thus, cooperative movement of the crankshaft gear 122 and the connecting rod gear 124 can be provided independently of movement provided by operation as described above with reference to FIGS. 10*a* to 10*c*.

The control member 126 can be rotated in either direction thereby providing for an advance or a delay of the particular point during a combustion cycle at which the piston is at its minimum and/or maximum lowest location in the crankcase during a combustion cycle.

To provide for transmission of an advance or a delay as described in the immediately preceding two paragraphs in an engine having more than one cylinder, a further pair of crankshaft and connecting rod gears 122, 124 (not shown) can be provided on the opposite side of the connecting rod and crankshaft section to the first pair shown in FIG. 11. Also, each further cylinder in the engine has the same arrangement of opposing pairs of crankshaft and connecting rod gears 122, 124. Opposing connecting rod gears 122 of a cylinder are coupled to each other via the connecting rod and adjacent crankshaft gears 124 of neighbouring cylinders are coupled to each other to transmit the advance or the delay from one cylinder to the next. Adjacent crankshaft gears 124 of neighbouring cylinders are coupled to each other by a further control member (like control member 126 of FIG. 11), which passes though a bore provided in the section of crankshaft between the neighbouring cylinders.

Figure 12:
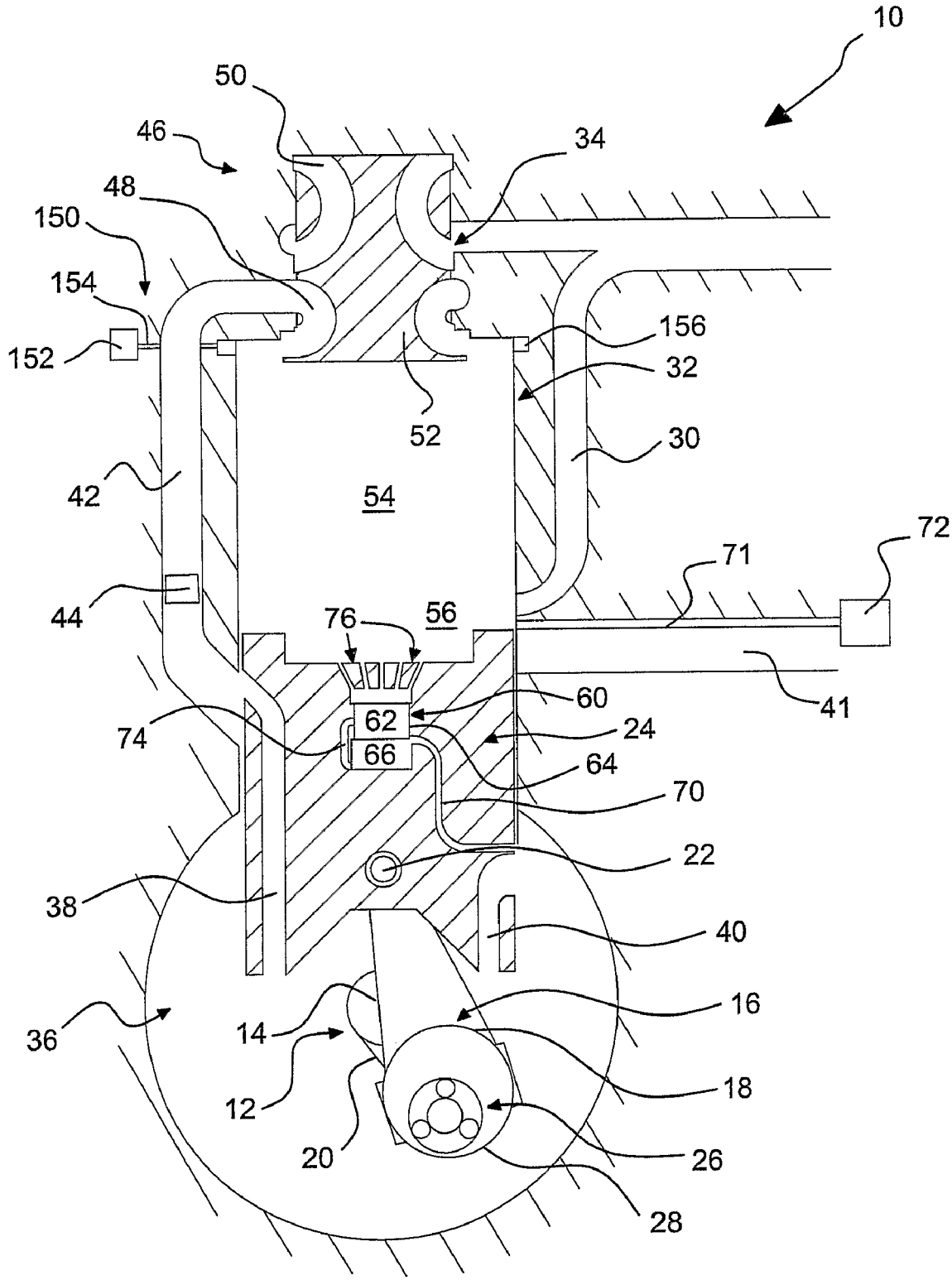
FIG. 12 is a schematic view of an internal combustion engine during a suction stroke and corresponding to that shown in FIG. 1 but having an alternative embodiment of combustion ignition means.

FIG. 12 provides a schematic view of an internal combustion engine during a suction stroke. FIG. 12 corresponds to FIG. 1 with the exception of an alternative embodiment of combustion ignition means 150. Accordingly reference should be made to the description given above with reference to FIG. 1 for a description of the component parts and operation that the present embodiment has in common with the previous embodiment.

In FIG. 12 the combustion ignition means 150 is located in the wall of the cylinder and comprises a laser 152 (which constitutes an optical energy generator) connected to a fibre optic cable 154 (which constitutes an energy conductor) which in turn is connected to diffusion means 156. Diffusion means 156 is of cylindrical form and extends around inside of the upper end of the cylinder. Such an arrangement of diffusion means can provide for an annular flame front that progresses towards the piston/cylinder centre. An advantage of locating the diffusion means 156 in the cylinder wall is that the diffusion means 156 can be swept and thus cleaned by the upper end of the piston during the course of a combustion cycle. In addition, the depth of the recess 56 provided in the leading face of the piston opposing the unitary device is reduced as shown in FIG. 12. During the exhaust stroke the piston moves to the very top of the cylinder. During the compression/ignition stroke the piston moves to within a predetermined distance to provide a workable compression space, thereby taking account of the reduction in the recess 56.

Figure 13A:
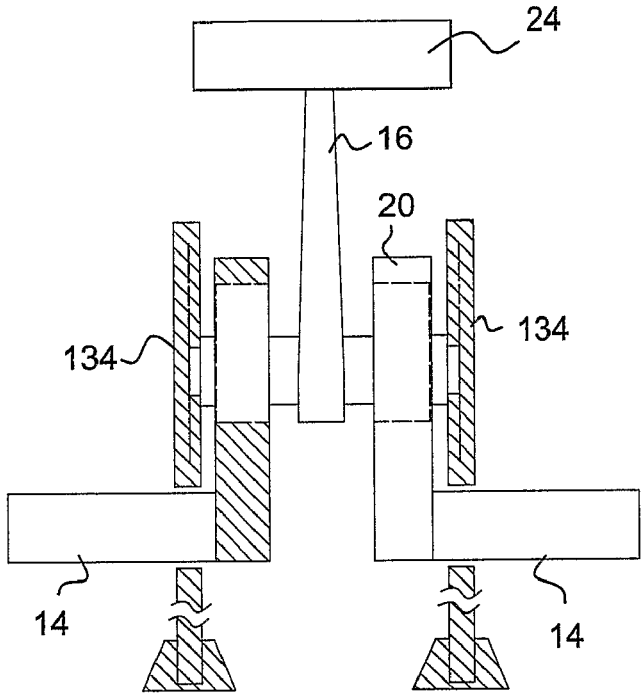
FIGS. 13*a* and 13*b* are transverse and axial schematic views of a further alternative embodiment.
Figure 13B:
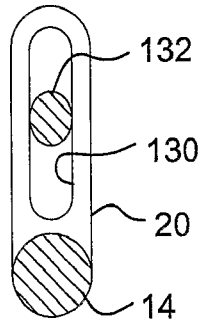

FIG. 13*a* shows in partial cross-section a further alternative arrangement for regulating the path of the big end of the connecting rod 16 so as to vary the displacement of the piston 24 in alternate revolutions of the crankshaft 14. Crank arms 20 in this case are provided with a slot 130 which receives pin 132 (and incorporated bearings) attached to big end of the connecting rod 16. FIG. 13*b* is a view of the crank arm and pin in an axial direction. In this way, the big end is forced to rotate about the crank axis while being permitted to move radially relative to crankshaft 14. Opposite ends of the pin 132 are constrained by fixed plates 134, which surround the crankshaft 14 and have channels cut in them to define paths of the form shown schematically in FIG. 14.

Figure 14:
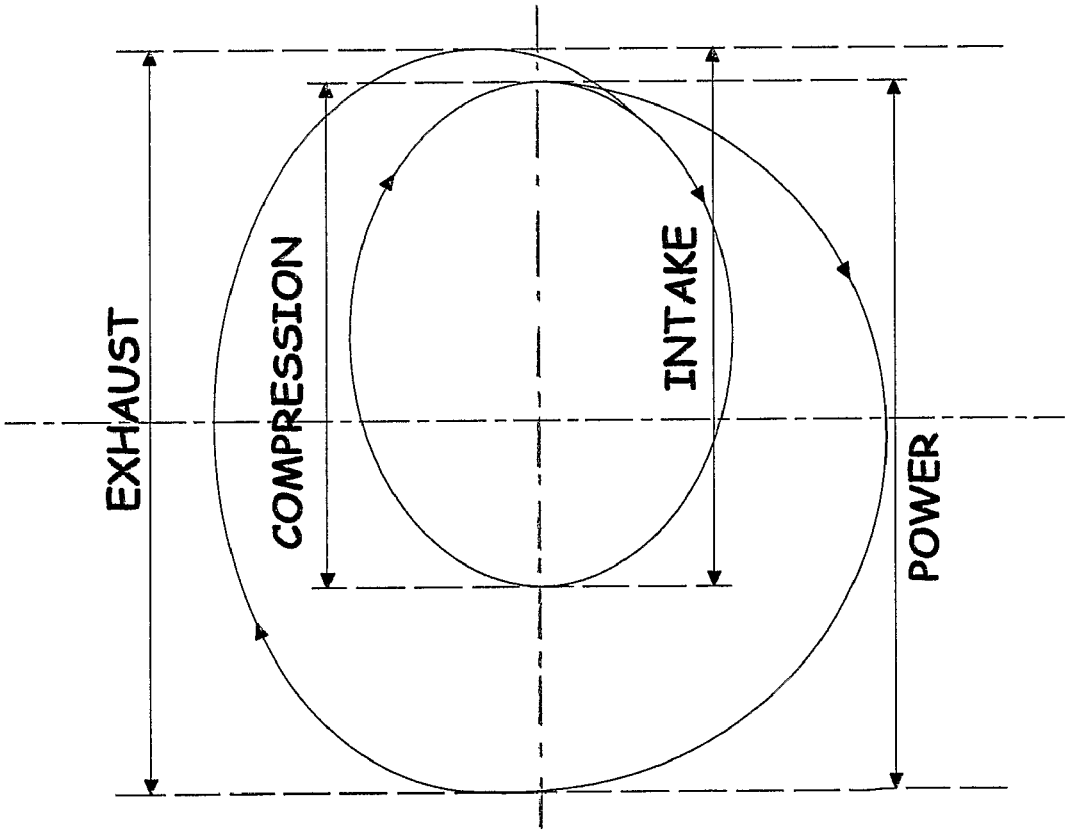
FIG. 14 depicts a path of the big end in the embodiment of FIGS. 13*a*, 13*b*.

Referring to FIG. 14, the locus of the axis of pin 132 is shown on a graph, with the crankshaft axis at its origin. The different extents of the intake, compression, power and exhaust parts of the cycle can clearly be seen. Furthermore, it can be seen that the path in the power stroke is essentially a semi-circle, while the path in the other strokes is more elliptical. This channeled path embodiment accordingly allows a more complex curve to be followed by the big end than can be achieved by the simple gear arrangements described already. This facility allows piston acceleration and decelerations to be reduced. If advancing or retarding the relationship between the paths and the crankshaft (via mechanical or electro-mechanical means) is of interest, it can be envisaged that the plates 134 be mounted so as to be rotatable in advance or retard controlled by electronic means to achieve a variation or optimisation of the path and it's timing, resulting in optimised engine performance and reduced emissions.

Modifications and Variations

The examples described above are illustrative only and many variations are possible within the spirit and scope of the invention as defined by the appended claims, and each aspect of the invention can be adopted alone or in combination with the others. For example: ignition by laser can be replaced by more conventional spark or compression ignition arrangements; fuel injection by piston action can be replaced by more conventional aspiration or injection arrangements and the unitary valve device can be replaced by more conventional valves. Several aspects of the invention are not limited in application to four-stroke engines, but can be applied for example in two-stroke engines, where a complete combustion cycle occurs in a single revolution of the crankshaft, as well as in pumps, compressors, hydraulic motors and other reciprocating machines.

Overview of Features and Benefits

Figure 15:
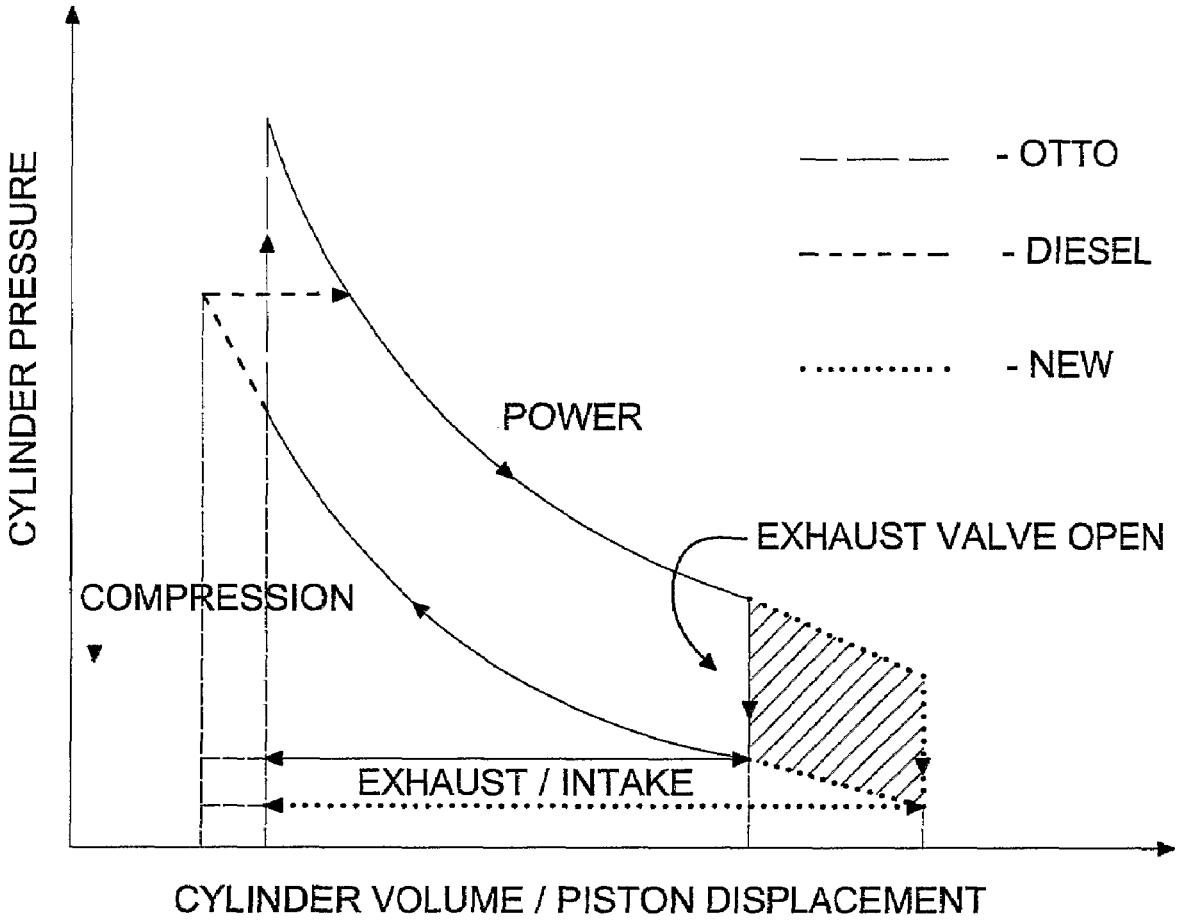
FIG. 15 is a graph illustrating thermodynamic principles of internal combustion engines and illustrating the additional useful work which the novel engines having an eccentric expansion stroke make available.

In answer to the elements of an 'ideal' reciprocating internal combustion engine mentioned in the introduction, the novel engines provide several new features and benefits of a subsidiary nature. The skilled person can select which of these features and benefits are important in a given application engine or machine, and they are presented above in combination for illustrative purposes only.

a) Thermodynamics:

More heat energy can be extracted as useable work by allowing the engine to vary its capacity cyclically between induction and expansion strokes. Consider the idealised situation whereby an engine induces 100 units of fuel/air mixture—but expands the combustion products through for example 130 units (a bit like the compound steam engine which extracts heat energy via an HP/IP/LP chain of expansions). With reference to FIG. 15 and the resulting extension of the power or expansion curve to include the shaded area, we have seen that a significant increase in power would result from each marginal increase in piston movement.

The novel engines described above achieve this varying capacity automatically and cyclically by adjusting the 'throw' of the crankshaft via an eccentrically pivoted big end bearing and driving arrangement introduced between the crank pin and the connecting rod big end bearing.

It should be noticed that a further benefit is derived from the increased moment arm of the crank during this eccentric motion—which results in a useful increase in engine torque during the power stroke.

b) Exhaust:

Since the piston extends to a lower bottom dead centre (BDC) at completion of the expansion stroke it is possible to incorporate a simple cylinder wall exhaust port (similar to that found on a two-stroke engine). Due to the eccentric feature, this port is only uncovered once during the four-stroke cycle. The bulk of exhaust gases can therefore be discharged through this porting arrangement. The traditional cylinder head mounted exhaust valve and port are subjected to considerably lower mass flows of hot exhaust gases—and a more thermally balanced engine block and exhaust valve environment results.

c) Purging and Valving:

As noted above, since the mass of exhaust gases left in the cylinder after BDC is significantly reduced by the action of the exhaust port arrangement, the function of the upper exhaust valve becomes one of purging only the remainder of these gases during the exhaust stroke. This reduction in thermal loading on the exhaust valve and its immediate downstream environment improves the conditions under which a combined inlet and exhaust valve becomes more feasible. By incorporating these functions into a single, optimally positioned and liberally sized poppet valve—with appropriate inlet and exhaust porting indexed to variable valve opening positions—the use of alternative valve materials such as ceramics, and more highly variable and energy efficient operating mechanisms such as magnetic induction—become more feasible.

To ensure complete purging of the exhaust gases, it is further arranged that the piston moves almost completely to cylinder head at top dead centre (TDC) with each stroke. The combustion chamber is located within the piston bowl—which in turn allows the combined inlet/exhaust valve to displace fully into this chamber at completion of the exhaust stroke to achieve a high gas discharge coefficient and fully purging the engine before a fresh intake of air passes through and cools the combined valve. These parts are shown with a rectangular cross-section for convenience only and can be shaped differently to improve mixing and combustion in practice.

It should be noted that by achieving a very high level of exhaust gas purging the secondary burning of previously combusted exhaust gases is largely avoided and the associate creation of undesirable oxides of nitrogen is greatly reduced. This also has benefits in the fact that the induced fresh charge has a high purity.

d) Supercharging:

The induction process was examined, and it was concluded that the displacement of the piston into a sealed crankcase provides a readily available method of positive displacement supercharging. The induction gases are forced into a crankcase port by atmospheric pressure during each upward displacement of the piston, and compressed by each downward movement. It is intended that a lower piston ring arrangement is provided to ensure gas tight sealing. Since this event happens twice during the four-stroke cycle (and in fact this displacement is even greater in the novel engine during the power/exhaust stroke sequence due to the eccentric effect described above), a viable source of effective supercharging can be exploited with a minimum of additional moving parts. The piston skirt area is arranged to provide both a passage for the inducted air into the crankcase and of the supercharged air into an intermediate chamber. Each of these functions is once again operated by the interaction of the piston and static ports in the cylinder wall—prior to the inlet valve opening to transfer this pressurised store of air into the engine.

The invention claimed is:

1. Apparatus for changing a maximum cylinder displacement in an internal combustion engine having a combustion cycle of at least four strokes, the apparatus comprising:

a crankshaft rotatable about a crankshaft axis, a connecting rod in engagement towards a first end with a throw of the crankshaft and configured to couple towards a second end to a piston in a cylinder of the internal combustion engine, and an eccentric coupling between the crankshaft and the connecting rod, wherein the eccentric coupling comprises an epicyclic gear means for coupling movement of the first end of the connecting rod to the throw of the crankshaft, the epicyclic gear means comprising a fixed gear fixedly located on the throw and a plurality of rotatable gears spaced apart around the fixed gear and a connecting rod gear rotatably located in the first end of the connecting rod, wherein the connecting rod gear defines an aperture which cooperates with the rotatable gears and in turn with the fixed gears, whereby movement of the connecting rod is coupled to movement of the crankshaft, and wherein the centre of the aperture defined by the connecting rod is offset from the centre of the first end of the connecting rod and with which the throw of the crankshaft rotatably engages.

2. An apparatus according to claim 1 wherein a lesser cylinder displacement is caused to occur during the first revolution of the crankshaft during the transition from a suction stroke to a compression stroke and a greater cylinder displacement during the second revolution of the crankshaft is caused to occur during the transition from an expansion stroke to an exhaust stroke.

3. Apparatus according to claim 1 configured to change from a point during a revolution of the crankshaft to the same point during a subsequent revolution of the crankshaft a location on at least one of the connecting rod and the throw of the crankshaft at which the first end of the connecting rod and the throw of the crankshaft engage with each other.

4. Apparatus according to claim 3 configured to change from a point during a revolution of the crankshaft to the same point during a subsequent revolution of the crankshaft a location on the connecting rod at which the first end of the connecting rod and the throw of the crankshaft engage with each other.

5. Apparatus according to claim 1 wherein the aperture and the throw of the crankshaft comprise respective teethed portions which engage with each other during travel of the throw around the internal circumference.

6. An internal combustion engine having a combustion cycle of at least four strokes comprising an arrangement according to claim 1.

7. An engine according to claim 6 comprising an exhaust gas aperture provided in a cylinder of the internal combustion engine, the internal combustion engine being configured to close the exhaust gas aperture during at least a compression stroke of the cycle and to open the exhaust gas aperture towards the end of an expansion stroke of the cycle, and wherein the exhaust gas aperture is in the vicinity of the piston when the piston is situated in the cylinder towards the end of the expansion stroke.

8. An engine according to claim 7 wherein the exhaust gas aperture is opened and closed by movement of the piston in the cylinder during the course of the cycle.

9. An engine according to claim 8 wherein the exhaust gas aperture is operative to open during a longer length of stroke of the piston and to remain closed during a shorter length of stroke of the piston during the cycle.

10. An engine according to claim 7 wherein the internal combustion engine further comprises an additional exhaust port located towards a top of the cylinder.

11. A vehicle comprising an internal combustion engine according to claim 1.

12. Apparatus for changing a maximum cylinder displacement in an internal combustion engine having a combustion cycle of at least four strokes, the apparatus comprising:

a crankshaft rotatable about a crankshaft axis, a connecting rod in engagement towards a first end with a throw of the crankshaft and configured to couple towards a second end to a piston in a cylinder of the internal combustion engine, a connecting rod gear located on the first end of the connecting rod, and a throw gear located on the throw of the crankshaft, wherein the crankshaft comprises a crank pin connected between two throws of the crankshaft, a first bearing concentric with the crank pin, and a second bearing eccentric to the crank pin, and wherein the throw gear is mounted on the first bearing and the connecting rod gear is mounted on the second bearing such that the throw gear and connecting rod gear engage directly with one another, and wherein the connecting rod gear is of greater diameter than the throw gear such that as the throw gear travels on a circumference of the connecting rod gear there is a progressive variation in the extent to which the throw gear (and hence the throw) is offset laterally of a centre line of the first end of the connecting rod during a combustion cycle.

13. Apparatus according to claim 12 operative such that the throw gear lies on the centre line of the first end of the connecting rod at two points during a four stroke combustion cycle.

14. Apparatus according to claim 12 wherein the first end of the connecting rod defines a connecting rod gear receiving aperture in which the connecting rod gear is rotatably located.

15. Apparatus according to claim 12 wherein the throw gear is rotatably mounted on the throw of the crankshaft.

16. An apparatus according to claim 12 wherein a lesser cylinder displacement is caused to occur during the first revolution of the crankshaft during the transition from a suction stroke to a compression stroke and a greater cylinder displacement during the second revolution of the crankshaft is caused to occur during the transition from an expansion stroke to an exhaust stroke.

17. Apparatus according to claim 12 configured to change from a point during a revolution of the crankshaft to the same point during a subsequent revolution of the crankshaft a location on at least one of the connecting rod and the throw of the crankshaft at which the first end of the connecting rod and the throw of the crankshaft engage with each other.

18. Apparatus according to claim 17 configured to change from a point during a revolution of the crankshaft to the same point during a subsequent revolution of the crankshaft a location on the connecting rod at which the first end of the connecting rod and the throw of the crankshaft engage with each other.

19. An internal combustion engine having a combustion cycle of at least four strokes comprising an arrangement according to claim 12.

20. An engine according to claim 19 comprising an exhaust gas aperture provided in a cylinder of the internal combustion engine, the internal combustion engine being configured to close the exhaust gas aperture during at least a compression stroke of the cycle and to open the exhaust gas aperture towards the end of an expansion stroke of the cycle, and wherein the exhaust gas aperture is in the vicinity of the piston when the piston is situated in the cylinder towards the end of the expansion stroke.

21. An engine according to claim 20 wherein the exhaust gas aperture is opened and closed by movement of the piston in the cylinder during the course of the cycle.

22. An engine according to claim 21 wherein the exhaust gas aperture is operative to open during a longer length of stroke of the piston and to remain closed during a shorter length of stroke of the piston during the cycle.

23. An engine according to claim 20 wherein the internal combustion engine further comprises an additional exhaust port located towards a top of the cylinder.

24. A vehicle comprising an internal combustion engine according to claim 12.

* * * * *